US006171772B1

(12) United States Patent
Ikeda et al.

(10) Patent No.: US 6,171,772 B1
(45) Date of Patent: Jan. 9, 2001

(54) SILVER HALIDE COLOR PHOTOSENSITIVE MATERIAL

(75) Inventors: Akira Ikeda; Takayuki Ito; Koji Takaku, all of Ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/291,935

(22) Filed: Apr. 15, 1999

(30) Foreign Application Priority Data

| | | |
|---|---|---|
| Apr. 16, 1998 | (JP) | 10-106796 |
| Sep. 30, 1998 | (JP) | 10-291391 |
| Mar. 17, 1999 | (JP) | 11-071661 |

(51) Int. Cl.[7] ..... G03C 1/34
(52) U.S. Cl. ..... 430/544; 430/956; 430/957
(58) Field of Search ..... 430/544, 956, 430/957

(56) References Cited

U.S. PATENT DOCUMENTS

| | | | |
|---|---|---|---|
| 3,958,993 | 5/1976 | Fujiwhara et al. | 430/442 |
| 4,482,629 | 11/1984 | Nakagawa et al. | 430/542 |
| 4,668,605 | 5/1987 | Okutsu et al. | 430/268 |
| 4,737,452 | 4/1988 | Kameoka et al. | 430/611 |
| 4,800,150 | 1/1989 | Katoh | 430/624 |
| 4,914,003 | 4/1990 | Yagihara et al. | 430/607 |
| 4,952,485 | 8/1990 | Shibahara et al. | 430/611 |
| 5,151,343 | 9/1992 | Begley et al. | 430/382 |
| 5,830,627 * | 11/1998 | Nakai et al. | 430/544 |

* cited by examiner

*Primary Examiner*—Hoa Van Le
(74) *Attorney, Agent, or Firm*—Birch, Stewart, Kolasch & Birch, LLP

(57) ABSTRACT

A silver halide color photosensitive material comprises blue-, green-, and red-sensitive silver halide emulsion layers on a support, and at least one layer of the material contains a compound represented by formula (I) below in an amount that satisfies a relation $X/(X+Y) \geqq 0.14$, wherein X is the molar amount of the compound represented by formula (I) and Y is the molar amount of a functional coupler other than the compound represented by formula (I) in the same color-sensitive layer or the color-sensitive layers having the same color sensitivity as the color-sensitive layer to which the compound is added, or in the same non-sensitive layer to which the compound is added, Formula (I) COUP—A—E—B, wherein COUP represents a coupler moiety capable of coupling with an oxidized form of an aromatic amine-based developing agent, E represents an electrophilic portion, A represents a coupling group capable of releasing B, along with ring formation, by intramolecular nucleophilic substitution between a nitrogen atom, which originates from the aromatic amine-based developing agent and directly bonds to the coupling position in the coupling product of COUP and the oxidized form of the developing agent, and the electrophilic portion E, and B represents a development inhibitor or its precursor.

18 Claims, 1 Drawing Sheet

SILVER HALIDE COLOR PHOTOSENSITIVE MATERIAL

BACKGROUND OF THE INVENTION

The present invention relates to a silver halide color photosensitive material containing a non-dye-forming coupler capable of releasing photographically useful group and, more particularly, to a silver halide photosensitive material containing a novel non-dye-forming DIR coupler capable of forming an essentially colorless cyclized product and releasing a development inhibitor or its precursor by intramolecular nucleophilic substitution using a nitrogen atom of an aromatic amine-based developing agent, which is produced by a coupling reaction with an oxidized form of the aromatic amine-based developing agent, as a nucleophilic seed.

In the field of color photosensitive materials, it is known that the properties of photographic images greatly improve by releasing a photographically useful group silver image-wise at the same time a silver image is formed.

For example, a DIR coupler releases a development inhibitor by coupling with an oxidized form of a developing agent upon development, thereby achieving functions of, e.g., improving the graininess of a color image, improving the sharpness by an edge effect, and improving the color reproduction by diffusion of the inhibitor to other layers. These functions are described in detail in, e.g., U.S. Pat. No. 4,248,962 and Jpn. Pat. Appln. KOKAI Publication No. (hereinafter referred to as JP-A-)5-313322.

As described above, DIR couplers contribute to improvements of the quality of a color image. However, these couplers release a development inhibitor or its precursor by coupling with an oxidized form of a developing agent and at the same form an azomethine dye or indoaniline dye. Therefore, these couplers sometimes have an unpreferable effect on the color reproduction of a color image or an adverse effect on the image stability. This is a large cause of limitations on the versatility, use amount, and molecular design of these functional couplers and on functions achieved by the couplers.

For example, a highly active DIR coupler is necessary to give a satisfactory interlayer effect from a green-sensitive layer to a blue-sensitive layer. Since, however, no high-activity DIR coupler for generating a magenta dye exists, a high-activity coupler for generating a yellow dye or cyan dye is used in a green-sensitive layer. These DIR couplers sometimes cancel the interlayer effect by their own color formation. Also, the use amount is restricted because color impurity may occur.

Instead of DIR compounds, color correcting colored couplers are sometimes used to obtain an apparent interlayer effect or to correct the hue of an unpreferable coupler. However, the use amount of these colored couplers is naturally limited by the suitability for a printer.

As means for solving these problems, couplers (non-dye-forming couplers) capable of releasing PUG (photographically useful groups including a development inhibitor) by coupling with an oxidized form of a developing agent without (essentially) forming a dye are described in, e.g., Jpn. Pat. Appln. KOKOKU Publication No. (hereinafter referred to as JP-B-)52-46817 and U.S. Pat. No. 4,315,070. Also, some couplers (flow couplers) release PUG by coupling with an oxidized form of a developing agent and at the same time form a dye, but this dye formed flows out into a processing solution during photographic processing. These couplers are described in, e.g., JP-B-1-52742, JP-A-4-356042, and JP-A-8-44011. However, the former non-dye-forming couplers have low coupling activity and are not stable enough. Also, a dye flowing out from the latter flow couplers pollute a processing solution. This is unpreferable when the recent progress of low-replenishment processing is taken into consideration.

As means for releasing PUG with no dye formation, a method using a redox reaction with an oxidized form of a developing agent is known. Examples are DIR-hydroquinones described in, e.g., JP-A-49-129536 and U.S. Pat. No. 4,377,643; DIR-aminophenols described in, e.g., JP-A-52-57828; p-nitrobenzyl derivatives described in, e.g., EP45129; and hydrazine derivatives described in, e.g., JP-A-8-211542. Unfortunately, compared to the functional couplers described above, these redox compounds generally have low stability with time in a sensitive material and are slow to release PUG after a redox reaction.

BRIEF SUMMARY OF THE INVENTION

It is an object of the present invention to provide a silver halide photosensitive material which improves its graininess, color reproduction, and sharpness by containing a non-dye-forming coupler capable of releasing a development inhibitor or its precursor immediately after reacting with an oxidized form of an aromatic amine-based developing agent without forming a dye.

The above object is achieved by (1) to (6) below.

(1) A silver halide color photosensitive material comprising blue-, green-, and red-sensitive silver halide emulsion layers on a support, wherein at least one layer of the material contains a compound represented by formula (I) below in an amount that satisfies a relation:

$X/(X+Y) \geqq 0.14$, wherein X is the molar amount of the compound represented by formula (I) and Y is the molar amount of a functional coupler other than the compound represented by formula (I) in the same color-sensitive layer or the color-sensitive layers having the same color sensitivity as the color-sensitive layer to which the compound is added, or in the same non-sensitive layer to which the compound is added COUP—A—E—B Formula (I)

wherein COUP represents a coupler moiety capable of coupling with an oxidized form of an aromatic amine-based developing agent, E represents an electrophilic portion, A represents a coupling group capable of releasing B, along with ring formation, by intramolecular nucleophilic substitution between a nitrogen atom, which originates from the aromatic amine-based developing agent and directly bonds to the coupling position in the coupling product of COUP and the oxidized form of the developing agent, and the electrophilic portion E, and B represents a development inhibitor or its precursor.

(2) The material according to item (1) above, wherein the compound represented by formula (I) is contained in the green-sensitive layer.

(3) The material according to item (1) above, wherein the compound represented by formula (I) is contained in the blue-sensitive layer.

(4) The material according to item (1) above, wherein the compound represented by formula (I) is contained in an interlayer effect donor layer by which a barycentric wavelength, $\lambda_{-R}$, of a magnitude distribution of an interlayer effect given to at least one red-sensitive layer at a wavelength of 500 to 600 nm satisfies a relation:

$$500\ \text{nm} \geqq \lambda_{-R} \geqq 600\ \text{nm}$$

and a relation:

$$\lambda_G - \lambda_{-R} \geqq 5 \text{ nm},$$

wherein $\lambda_G$ is a barycentric wavelength of the green-sensitive layer.

(5) The silver halide color photosensitive material according to item (1) above, wherein the compound represented by formula (I) is contained in the red-sensitive layer.

(6) The silver halide color photosensitive material according to item (1) above, wherein the compound represented by formula (I) is contained in a non-sensitive layer.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

DETAILED DESCRIPTION OF THE INVENTION

Figure 1A:
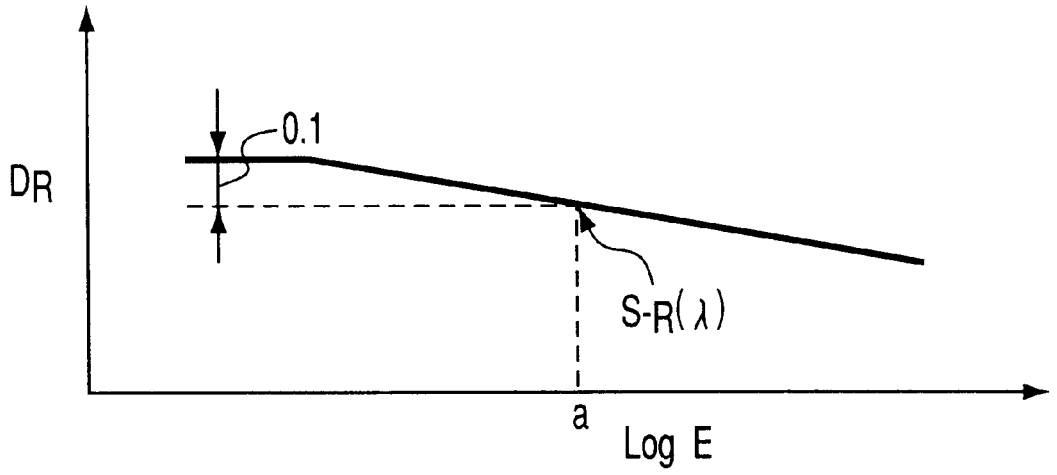
FIG. 1A is a view showing the spectral sensitivity distribution curve of a red-sensitive layer.

The compound represented by formula (I) will be described in detail below.

As a coupler moiety represented by COUP, coupler moieties generally known as photographic couplers can be used. Examples are yellow coupler moieties (e.g., open chain ketomethine type coupler moieties such as acylacetanilide and malondianilide), magenta coupler moieties (e.g., 5-pyrazolon type and pyrazolotriazole type coupler moieties), and cyan coupler moieties (e.g., phenol type, naphthol type, and pyrrolotriazole type coupler moieties). It is also possible to use yellow, magenta, and cyan dye forming couplers having novel skeletons described in, e.g., U.S. Pat. No. 5,681,689, JP-A-7-128824, JP-A-7-128823, JP-A-6-222526, JP-A-9-258400, JP-A-9-258401, JP-A-9-269573, and JP-A-6-27612, all the disclosures of which are herein incorporated by reference. Other coupler moieties can also be used (e.g., coupler moieties described in U.S. Pat. Nos. 3,632,345 and 3,928,041, which form a colorless substance by reacting with an oxidized form of an aromatic amine-based developing agent and coupler moieties described in U.S. Pat. Nos. 1,939,231 and 2,181,944, which form a black or intermediate-color substance by reacting with an oxidized form of an aromatic amine-based developing agent, all the disclosures of which are herein incorporated by reference).

The bonding position of COUP and the coupling group A can be any position provided that after a coupler and an oxidized form of a developing agent couple with each other, B can be released along with ring formation by intramolecular nucleophilic substitution between a nitrogen atom, which arises from the developing agent and directly bonds to the coupling position in the coupling product, and the electrophilic portion E. The position is preferably the coupling position of COUP or its nearby position (an atom adjacent to the coupling position or an atom adjacent to this adjacent atom), and more preferably the nearby position (an atom adjacent to the coupling position or an atom adjacent to this adjacent atom) of the coupling position of COUP.

When the coupling group A bonds to 1) the coupling position of a coupler moiety represented by COUP, 2) an atom adjacent to the coupling position, and 3) an atom adjacent to the atom adjacent to the coupling position, a reaction between a coupler represented by-formula (I) of the present invention and an oxidized form (Ar'═NH) of an aromatic amine-based developing agent represented by $ArNH_2$ can be represented by 1) In the case where A binds at the coupling position of COUP.

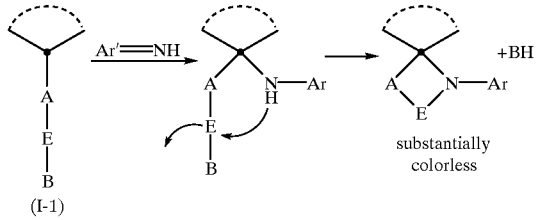

2) In the case where A binds at the atom next to the coupling position of COUP.

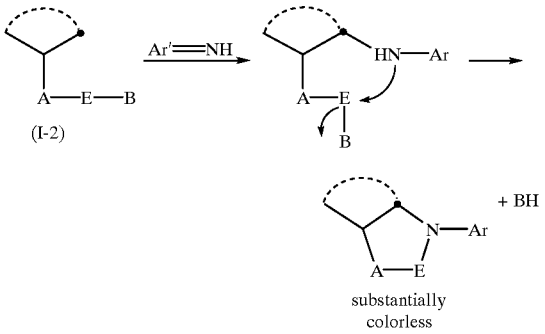

3) In the case where A binds at the atom next but one to the coupling position of COUP.

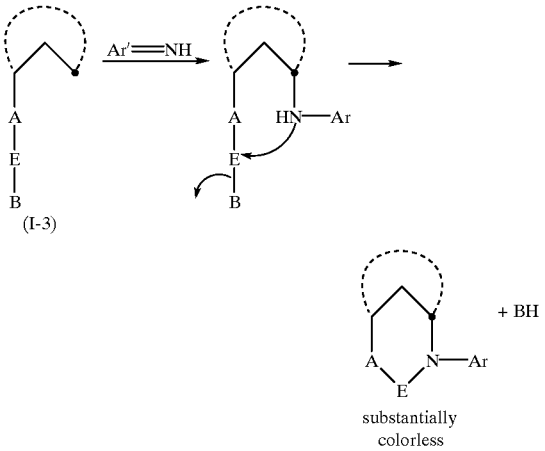

In the above formulas, each of

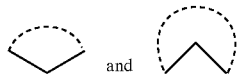

represents a coupler residue capable of coupling with a development agent in an oxidized form, which does not necessarily represent a ring structure. • (dot) represents the coupling position. — (line) represents a linkage between nonmetal atoms.

Preferable examples of COUP will be presented below, but the invention is not limited to these examples.

(I-1A)

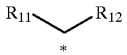

(I-2A)

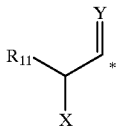

(I-1B)

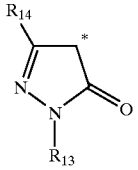

(I-2B)

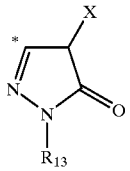

(I-1C)

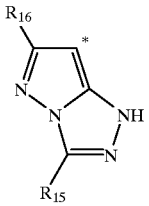

(I-2C)

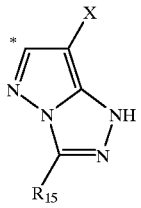

-continued (I-1D)

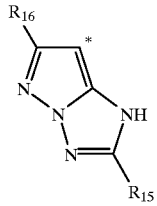

(I-2D)

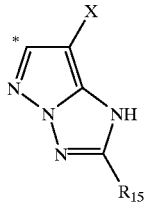

(I-1E)

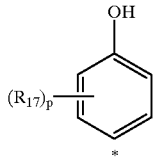

(I-2E)

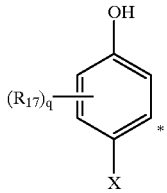

(I-1F)

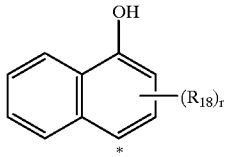

(I-2F)

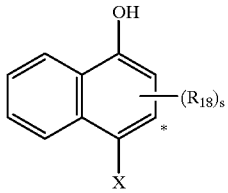

(I-3F)

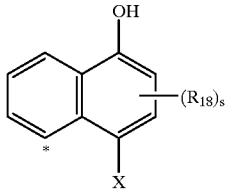

-continued (I-1G)

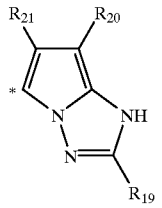

(I-2G)

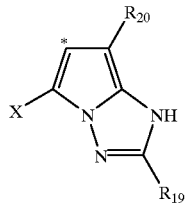

wherein * represents a position of bonding to A, X represents a hydrogen atom, halogen atom (e.g., a fluorine atom, chlorine atom, bromine atom, or iodine atom), $R_{31}$—, $R_{31}O$—, $R_{31}S$—, $R_{31}OCOO$—, $R_{32}COO$—, $R_{32}(R_{33})NCOO$—, or $R_{32}CON(R_{33})$—, Y represents an oxygen atom, sulfur atom, $R_{32}N$═, or $R_{32}ON$═.

$R_{31}$ represents an aliphatic group (an "aliphatic group" means a saturated or unsaturated, chain or cyclic, straight-chain or branched, and substituted or nonsubstituted aliphatic hydrocarbon group, and an aliphatic group used in the following description has the same meaning), aryl group, or heterocyclic group.

The aliphatic group represented by $R_{31}$ is an aliphatic group having preferably 1 to 32 carbon atoms, and more preferably 1 to 22 carbon atoms. Examples are methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl, and octadecyl. If the aliphatic group is a substituted aliphatic group, the number of "carbon atoms" is the total number of carbon atoms including carbon atoms of the substituent. The number of carbon atoms of a group other than an aliphatic group also means the total number of carbon atoms including carbon atoms of a substituent.

The aryl group represented by $R_{31}$ is a substituted or nonsubstituted aryl group having preferably 6 to 32 carbon atoms, and more preferably 6 to 22 carbon atoms. Examples are phenyl, tolyl, and naphthyl.

The heterocyclic group represented by $R_{31}$ is a substituted or nonsubstituted heterocyclic group having preferably 1 to 32 carbon atoms, and more preferably 1 to 22 carbon atoms. Examples are 2-furyl, 2-pyrrolyl, 2-thienyl, 3-tetrahydrofuranyl 4-pyridyl, 2-pyrimidinyl, 2-(1,3,4-thiadiazolyl), 2-benzothiazolyl, 2-benzoxazolyl, 2-benzoimidazolyl, 2-benzoselenazolyl, 2-quinolyl, 2-oxazolyl, 2-thiazolyl, 2-selenazolyl, 5-tetrazolyl, 2-(1,3,4-oxadiazolyl), and 2-imidazolyl.

Each of $R_{32}$ and $R_{33}$ independently represents a hydrogen atom, aliphatic group, aryl group, or heterocyclic group. The aliphatic group, aryl group, and heterocyclic group represented by $R_{32}$ and $R_{33}$ have the same meanings as those represented by $R_{31}$, respectively.

Preferably, X represents a hydrogen atom, aliphatic group, aliphatic oxy group, aliphatic thio group, or $R_{32}CON(R_{33})$—, and Y represents an oxygen atom.

Examples of substituents suited to the groups described above and groups to be described below and examples of "substituents" to be described below are a halogen atom (e.g., a fluorine atom, chlorine atom, bromine atom, and iodine atom), hydroxyl group, carboxyl group, sulfo group, cyano group, nitro group, alkyl group (e.g., methyl, ethyl, and hexyl), fluoroalkyl group (e.g., trifluoromethyl), aryl group (e.g., phenyl, tolyl, and naphthyl), heterocyclic group (e.g., a heterocyclic group having the same meaning as $R_{31}$), alkoxy group (e.g., methoxy, ethoxy, and octyloxy), aryloxy group (e.g., phenoxy and naphthyloxy), alkylthio group (e.g., methylthio and butylthio), arylthio group (e.g., phenylthio), amino group (e.g., amino, N-methylamino, N,N-dimethylamino, and N-phenylamino), acyl group (e.g., acetyl, propionyl, and benzoyl), alkylsulfonyl and arylsulfonyl groups (e.g., methylsulfonyl and phenylsulfonyl), acylamino group (e.g., acetylamino and benzoylamino), alkylsulfonylamino and arylsulfonylamino groups (e.g., methanesulfonylamino and benzenesulfonylamino), carbamoyl group (e.g., carbamoyl, N-methylaminocarbonyl, N,N-dimethylaminocarbonyl, and N-phenylaminocarbonyl), sulfamoyl group (e.g., sulfamoyl, N-methylaminosulfonyl, N,N-dimethylaminosulfonyl, and N-phenylaminosulfonyl), alkoxycarbonyl group (e.g., methoxycarbonyl, ethoxycarbonyl, and octyloxycarbonyl), aryloxycarbonyl group (e.g., phenoxycarbonyl and naphthyloxycarbonyl), acyloxy group (e.g., acetyloxy and benzoyloxy), alkoxycarbonyloxy group (e.g., methoxycarbonyloxy and ethoxycarbonyloxy), aryloxycarbonyloxy group (e.g., phenoxycarbonyloxy), alkoxycarbonylamino group (e.g., methoxycarbonylamino and butoxycarbonylamino), aryloxycarbonylamino group (e.g., phenoxycarbonylamino), aminocarbonyloxy group (e.g., N-methylaminocarbonyloxy and N-phenylaminocarbonyloxy), aminocarbonylamino group (e.g., N-methylaminocarbonylamino and N-phenylaminocarbonylamino).

Each of $R_{11}$ and $R_{12}$ independently represents $R_{32}CO$—, $R_{31}OCO$—, $R_{32}(R_{33})NCO$—, $R_{31}SO_n$—, $R_{32}(R_{33})NSO_2$—, or a cyano group. $R_{31}$, $R_{32}$, and $R_{33}$ have the same meanings as above. n represents 1 or 2.

$R_{13}$ represents a group having the same meaning as $R_{31}$.

$R_{14}$ represents $R_{32}$—, $R_{32}CON(R_{33})$—, $R_{32}(R_{33})N$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$—, or a cyano group. $R_{31}$, $R_{32}$, and $R_{33}$ have the same meanings as above. $R_{34}$ represents a group having the same meaning as $R_{32}$.

Each of $R_{15}$ and $R_{16}$ independently represents a substituent, preferably $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$—, a halogen atom, or cyano group, and more preferably a group represented by $R_{31}$. $R_{31}$, $R_{32}$, $R_{33}$, and $R_{34}$ have the same meanings as above.

$R_{17}$ represents a substituent, p represents an integer from 0 to 4, and q represents an integer from 0 to 3. Preferable examples of a substituent represented by $R_{17}$ are $R_{31}$—, $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, and a halogen atom. $R_{31}$, $R_{32}$, $R_{33}$, and $R_{34}$ have the same meanings as above. If p and q are 2 or more, a plurality of $R_{17}$'s can be the same or different, and adjacent $R_{17}$'s can combine with each other to form a ring. In preferable forms of formulas (I-1E) and (I-2E), at least one of the two ortho positions with respect to the hydroxyl group is substituted by $R_{32}CONH$—, $R_{31}OCONH$—, or $R_{32}(R_{33})NCONH$—.

$R_{18}$ represents a substituent, r presents an integer from 0 to 6, and s represents an integer from 0 to 5. Preferable examples of a substituent represented by $R_{18}$ are $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group, and halogen atom. $R_{31}$, $R_{32}$, $R_{33}$, and $R_{34}$ have the same meanings as above. When r and s are 2 or more, a plurality of $R_{18}$'s can be the same or different, and adjacent $R_{18}$'s can combine with each other to form a ring. In preferable forms of formulas (I-1F), (I-2F), and (I-3F), an ortho position to a hydroxyl group is substituted by $R_{32}CONH$—, $R_{32}HNCONH$—, $R_{32}(R_{33})NSO_2$—, or $R_{32}NHCO$—.

$R_{19}$ represents a substituent, preferably $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NSO_2$—, $R_{32}(R_{33})NCO$—, a halogen atom, or cyano group, and more preferably a group represented by $R_{31}$. $R_{31}$, $R_{32}$, $R_{33}$, and $R_{34}$ have the same meanings as above.

Each of $R_{20}$ and $R_{21}$ independently represents a substituent, preferably $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{32}(R_{33})NCO$—, $R_{32}(R_{33})NSO_2$—, $R_{31}OCO$—, a halogen atom, or cyano group, and more preferably $R_{32}(R_{33})NCO$—, $R_{32}(R_{33})NSO_2$—, a trifluoromethyl group, $R_{31}OCO$—, or cyano group. $R_{31}$, $R_{32}$, $R_{33}$, and $R_{34}$ have the same meanings as above.

E represents an electrophilic group such as —CO—, —CS—, —COCO—, —SO—, —$SO_2$—, —P(=O)($R_{51}$)—, or —P(=S)($R_{51}$)—, wherein $R_{51}$ represents an aliphatic group, aryl group, aliphatic oxy group, aryloxy group, aliphatic thio group, or arylthio group, and preferably —CO—.

A represents a coupling group capable of releasing B, along with formation of a ring, that is preferably a 3- to 7-membered ring, and more preferably a 5- or 6-membered ring, by intramolecular nucleophilic substitution between a nitrogen atom, which arises from a developing agent and directly bonds to the coupling position in the coupling product, and the electrophilic portion E. A preferable form of A can be represented by formula (II) below (II)

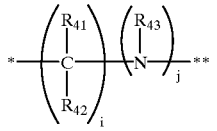

wherein * represents a portion coupling with COUP, and ** represents a portion coupling with E. Each of $R_{41}$, $R_{42}$, and $R_{43}$ independently represents a group having the same meaning as $R_{32}$. i represents an integer from 0 to 3, and j represents an integer from 0 to 2. $R_{41}$ or $R_{42}$ can combine with COUP or $R_{43}$ to form a ring, or $R_{41}$ and $R_{42}$ can combine with each other to form a spiro ring. When i is 2 or 3, a plurality of $R_{41}$'s or $R_{42}$'s can be the same or different, and adjacent $R_{41}$'s can combine with each other to form a ring, and adjacent $R_{42}$'s can combine with each other to form a ring. Each of $R_{41}$ and $R_{42}$ is preferably a hydrogen atom or aliphatic group having 1 to 20 carbon atoms, preferably 1 to 10 carbon atoms, and more preferably a hydrogen atom. $R_{43}$ is preferably an aliphatic group having 1 to 32 carbon atoms, and more preferably an aliphatic group having 1 to 22 carbon atoms, and can combine with COUP to form a ring. When j is 2, two $R_{43}$'s can be the same or different, and adjacent $R_{43}$'s can form a ring. j is preferably 1. i is preferably 1 or 2 in formula (I-1), wherein COUP is preferably represented by (I-1A), (I-1B), (I-1C), (I-1D), (I-1E), (I-1F), or (I-1G). i is preferably 0 or 1 in formula (I-2), wherein COUP is preferably represented by (I-2A), (I-2B), (I-2C), (I-2D), (I-2E), (I-2F), or (I-2G). i is preferably 0 in formula I-3, wherein COUP is preferably represented by (I-3F).

B represents a photographically useful group or its precursor. A preferable form of B is represented by formula (III) below $$\#\text{–}(T)_k\text{–}DI \qquad \text{(III)}$$

wherein # represents a portion coupling with E, T represents a timing group capable of releasing DI after being released from E, k represents an integer from 0 to 2, preferably 0 or 1, and DI represents a development inhibitor.

Examples of a timing group represented by T are a group described in U.S. Pat. Nos. 4,146,396, 4,652,516, or 4,698,297, which releases PUG by using a cleavage reaction of hemiacetal; a group described in JP-A-9-114058 or U.S. Pat. Nos. 4,248,962, 5,719,017, or 5,709,987, which releases PUG by using an intramolecular ring closure reaction; a group described in JP-B-54-39727, JP-A-57-136640, JP-A-57-154234, JP-A-4-261530, JP-A-4-211246, JP-A-6-324439, JP-A-9-114058, or U.S. Pat. Nos. 4,409,323 or 4,421,845, which releases PUG by using electron transfer via π electrons; a group described in JP-A-57-179842, JP-A-4-261530, or JP-A-5-313322, which releases PUG by generating carbon dioxide; a group described in U.S. Pat. No. 4,546,073, which releases PUG by using a hydrolytic reaction of iminoketal; a group described in laid-open West German Patent 2,626,317, which releases PUG by using a hydrolytic reaction of ester; and a group described in EP572084, which releases PUG by using a reaction with sulfurous acid ions, the disclosures of all the references are herein incorporated by reference.

Preferable examples of the timing group represented by T in formula (III) of the present invention are set forth below. However, the present invention is not limited to these examples.

(T1)

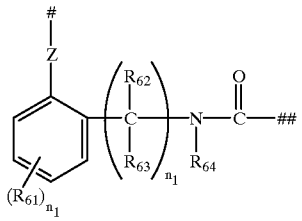

(T2)

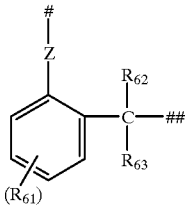

-continued (T3)

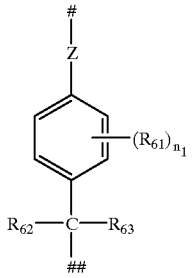

(T4)

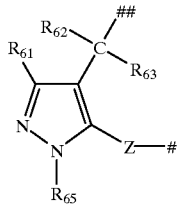

wherein # represents a portion coupling with the electrophilic portion E or ##, and ## represents a position coupling with PUG or #. Z represents an oxygen atom or sulfur atom, preferably an oxygen atom. $R_{61}$ represents a substituent, preferably $R_{31}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{32}(R_{33})NCO$—, $R_{32}(R_{33})NSO_2$—, $R_{31}OCO$—, a halogen atom, nitro group, or cyano group. $R_{31}$, $R_{32}$, $R_{33}$, and $R_{34}$ have the same meanings as above. $R_{61}$ can combine with any of $R_{62}$, $R_{63}$, and $R_{64}$ to form a ring. $n_1$ represents an integer from 0 to 4. When $n_1$ represents 2 or more, a plurality of $R_{61}$'s can be the same or different and can combine with each other to form a ring.

Each of $R_{62}$, $R_{63}$, and $R_{64}$ independently represents a group having the same meaning as $R_{32}$. $n_2$ represents 0 or 1. $R_{62}$ and $R_{63}$ can combine with each other to form a spiro ring. Each of $R_{62}$ and $R_{63}$ is preferably a hydrogen atom or an aliphatic group having 1 to 20, preferably 1 to 10 carbon atoms, and more preferably a hydrogen atom. $R_{64}$ is preferably an aliphatic group having 1 to 20, preferably 1 to 10 carbon atoms or an aryl group having 6 to 20, preferably 6 to 10 carbon atoms). $R_{65}$ represents $R_{32}$—, $R_{32}(R_{33})NCO$—, $R_{32}(R_{33})NSO_2$—, $R_{31}OCO$—, or $R_{32}CO$—. $R_{31}$, $R_{32}$, and $R_{33}$ have the same meanings as above. $R_{65}$ represents preferably $R_{32}$, and more preferably an aryl group having 6 to 20 carbon atoms.

The development inhibitor represented by DI is preferably selected from a mercaptotetrazole derivative, mercaptotriazole derivative, mercaptothiadiazole derivative, mercaptoxadiazole derivative, mercaptoimidazole derivative, mercaptobenzimidazole derivative, mercaptobenzthiazole derivative, mercaptothiadiazole derivative, tetrazole derivative, 1,2,3-triazole derivative, 1,2,4-triazole derivative, and benzotriazole derivative.

Of these development inhibitor, particularly preferable ones are as follows:

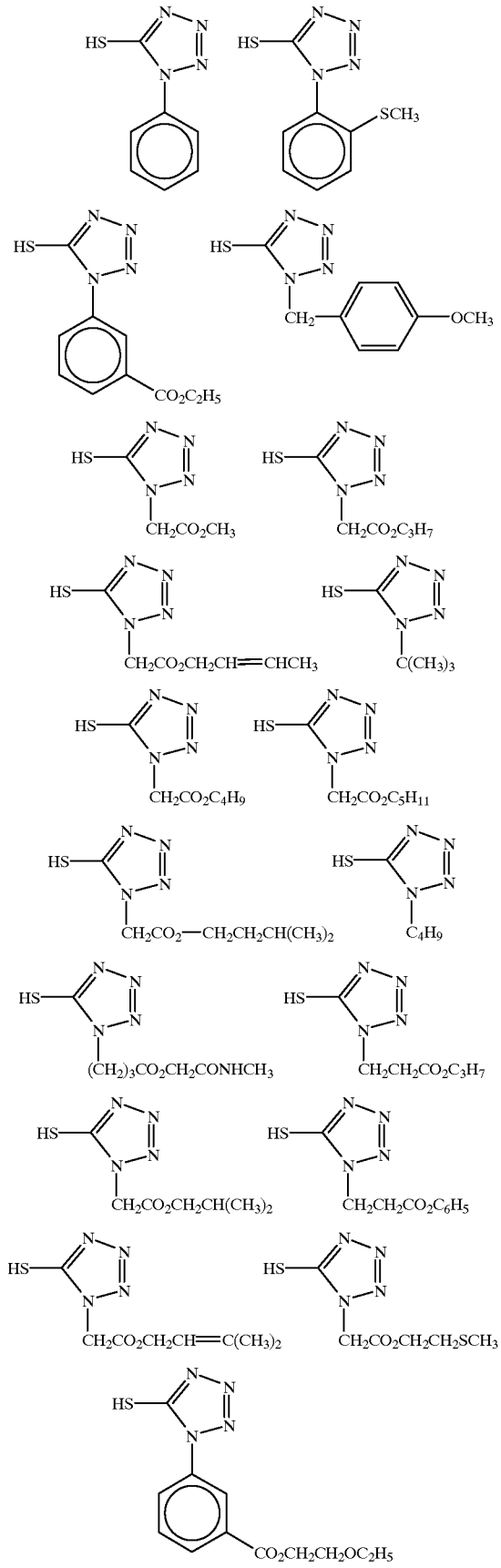

-continued

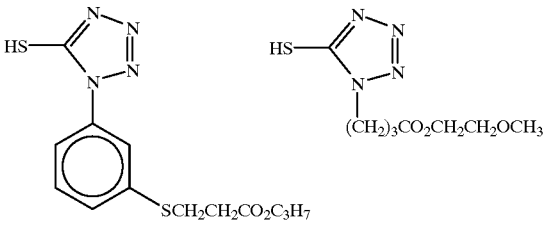

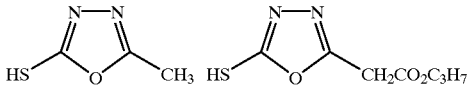

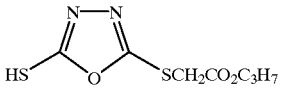

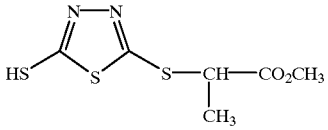

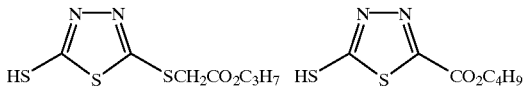

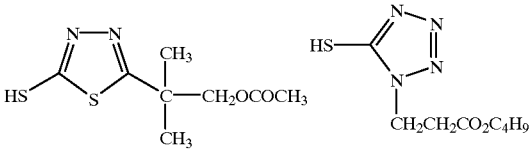

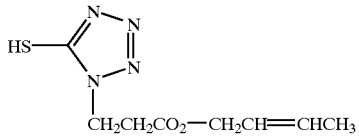

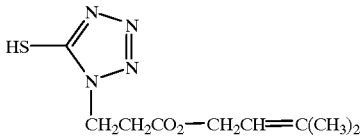

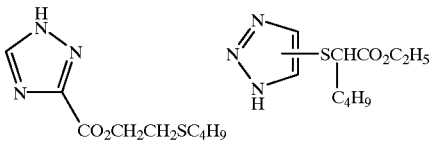

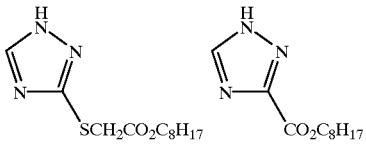

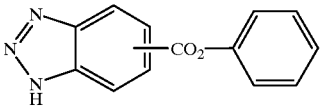

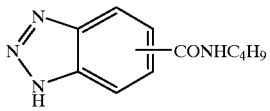

-continued

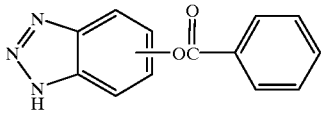

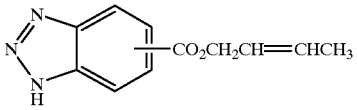

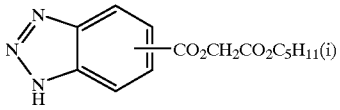

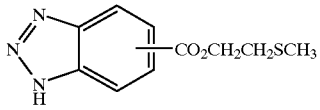

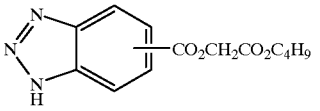

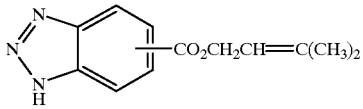

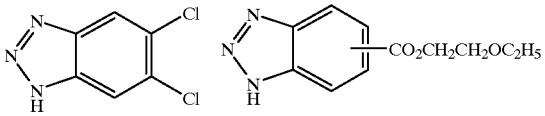

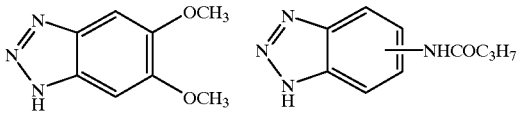

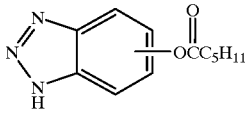

The compound represented by formula (I) of the present invention is preferably represented by formula (I-2) in which A bonds to the next atom to the coupling position of COUP, or formula (I-3) in which A bonds to the atom next but one to the coupling position of COUP, and most preferably formula (I-3). The compound represented by formula (I-3) is represented by preferably formula (I-3a), more preferably formula (I-3b), and most preferably formula (I-3c) presented below. The structure of a cyclized product obtained by the reaction between formula (I-3c) and an oxidized form (Ar'=NH) of an aromatic amine-based developing agent represented by $ArNH_2$ can be represented by formula (IV) below:

(I-3a)

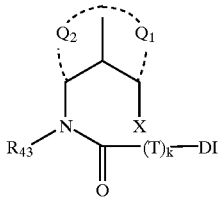

-continued (I-3b)

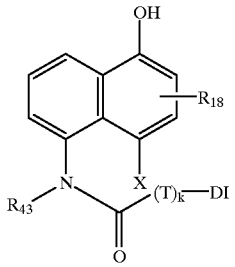

(I-3c)

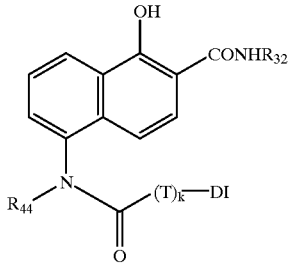

-continued (IV)

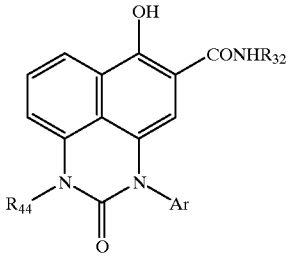

wherein each of $Q_1$ and $Q_2$ represents a nonmetallic atomic group necessary to form a 5- to 6-membered ring and couple with an oxidized form of a developing agent by an atom at the root of X, each of X, T, k, DI, $R_{18}$, S, $R_{32}$, and $R_{43}$ has the same meaning as above, and $R_{44}$ represents a substituted or nonsubstituted aliphatic group having 1 to 32 carbon atoms.

Practical examples of the compound represented by formula (I) used in sensitive materials of the present invention will be presented below. However, the present invention is not limited to these examples.

(1)

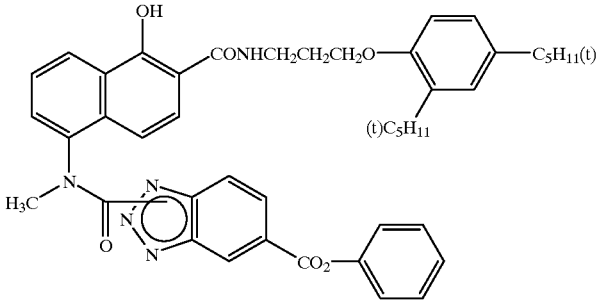

(2)

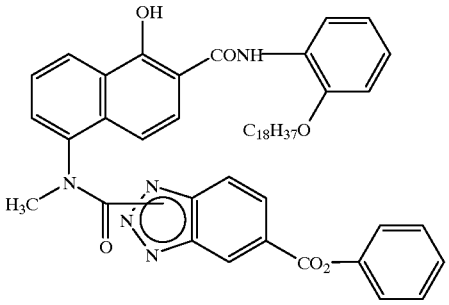

(3)

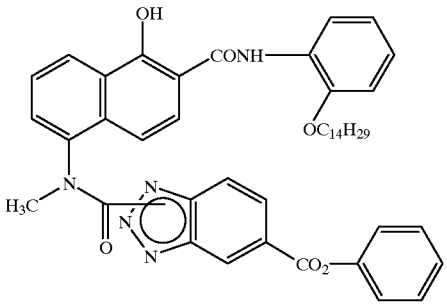

-continued
(4)
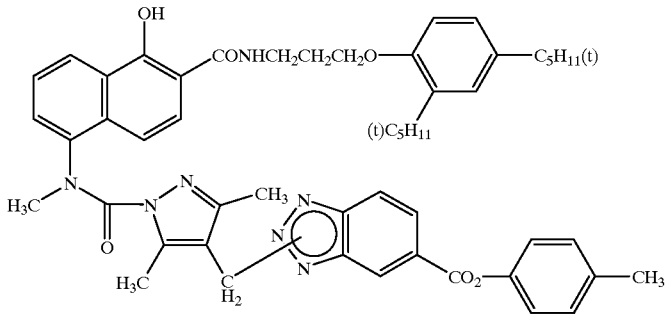
(5)
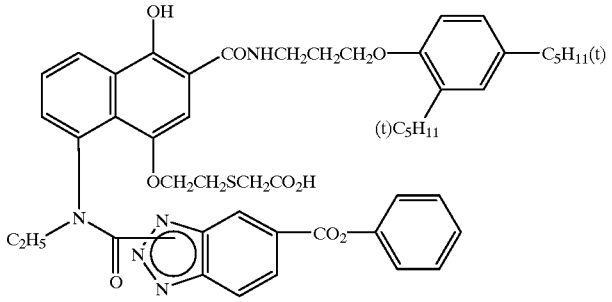
(6)
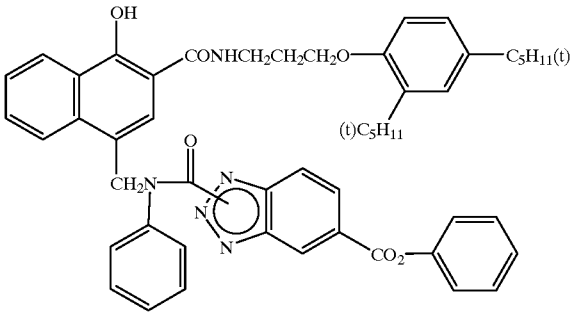
(7)
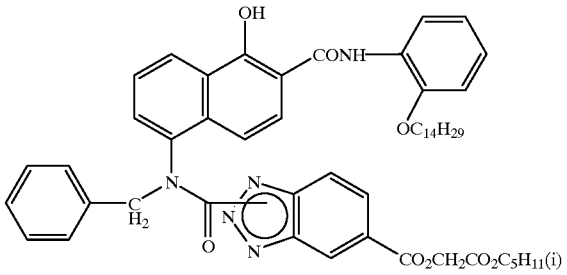
(8)
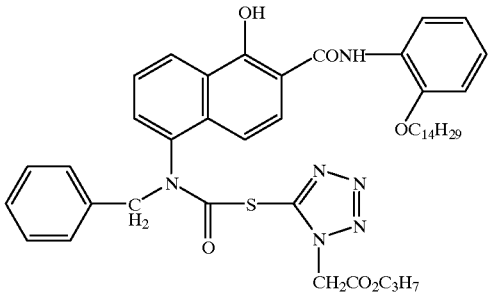

-continued
(9)
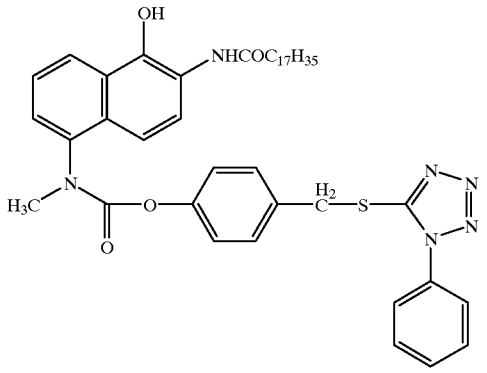
(10)
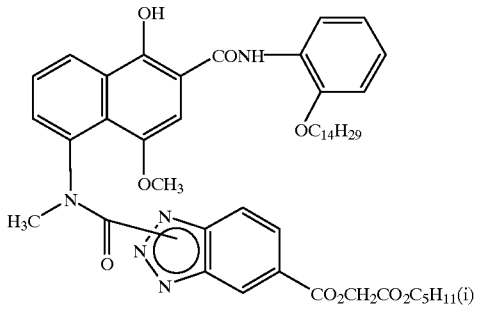
(11)
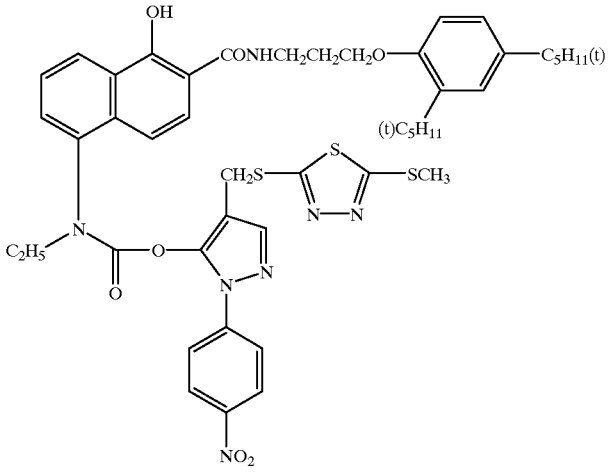
(12)
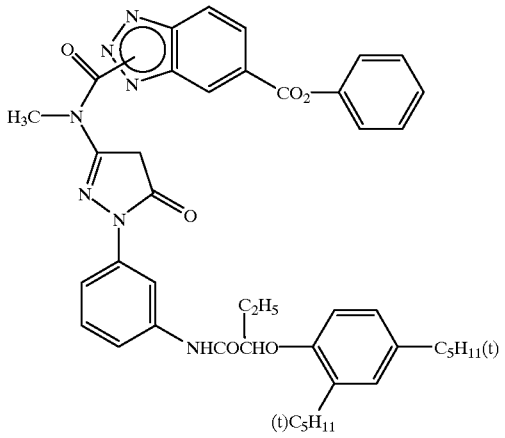

-continued
(13)
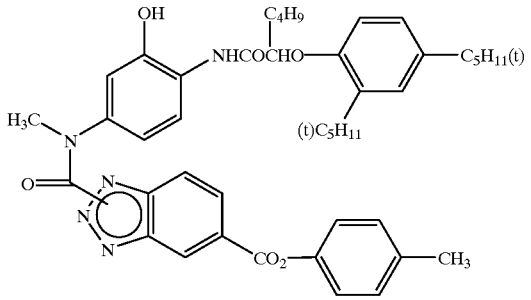
(14)
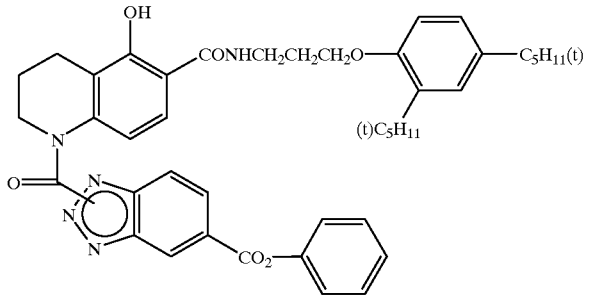
(15)
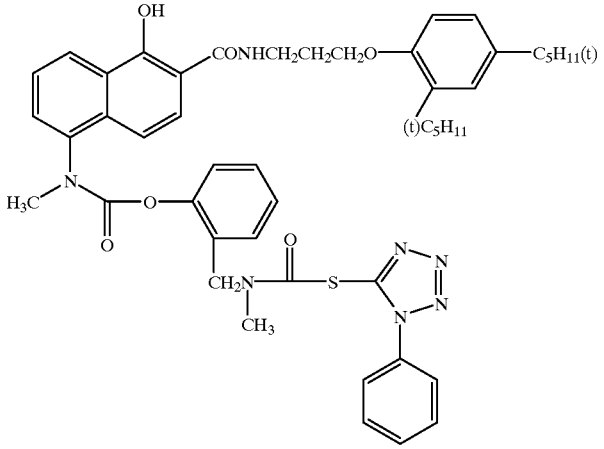
(16)
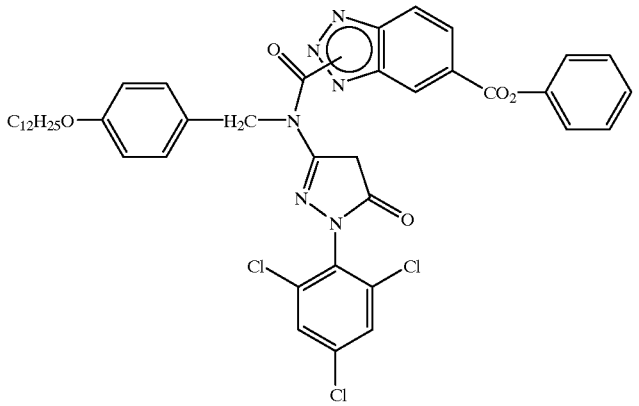

-continued
(17)
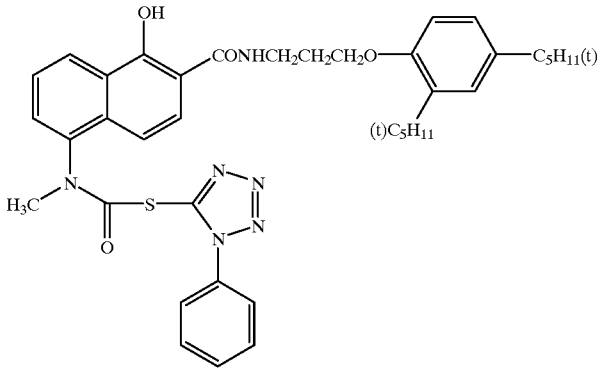
(18)
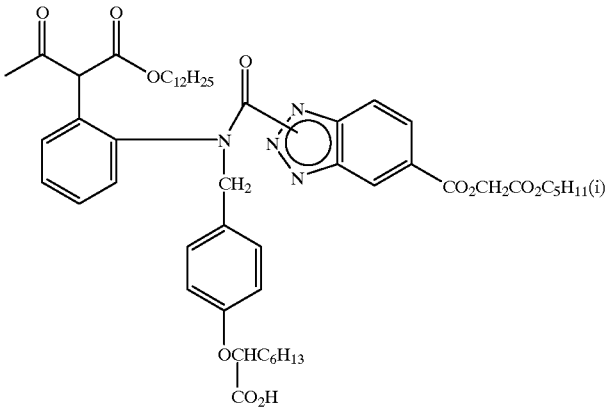
(19)
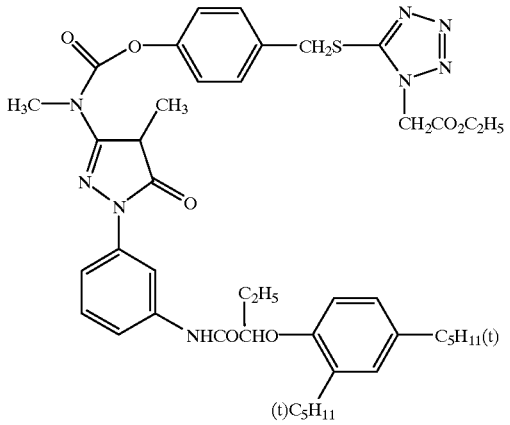
(20)
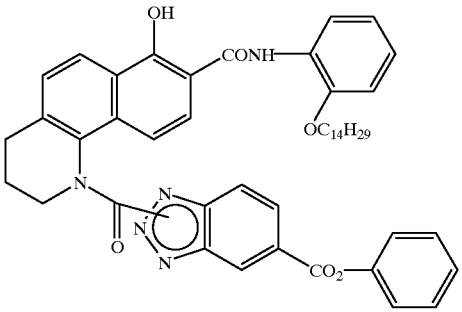

-continued
(21)
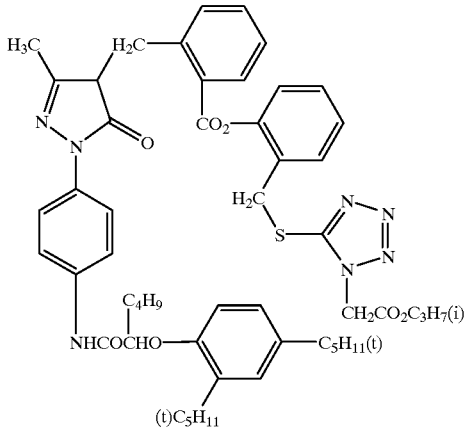
(22)
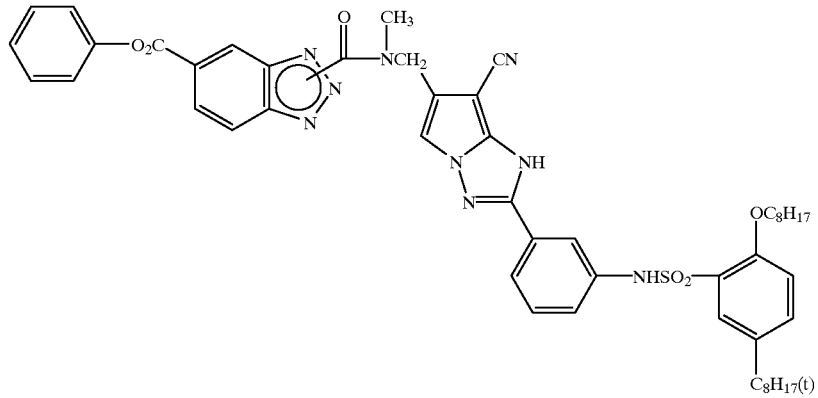
(23)
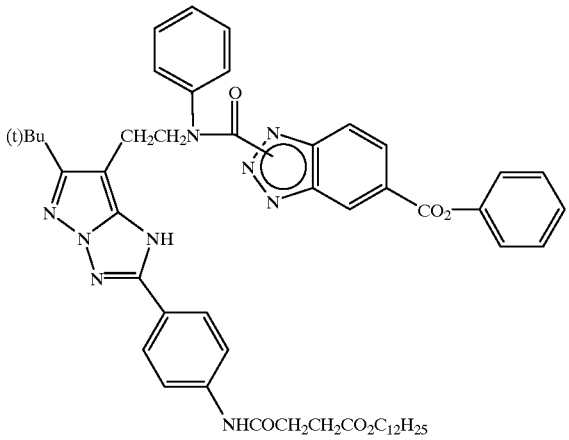

-continued
(24)
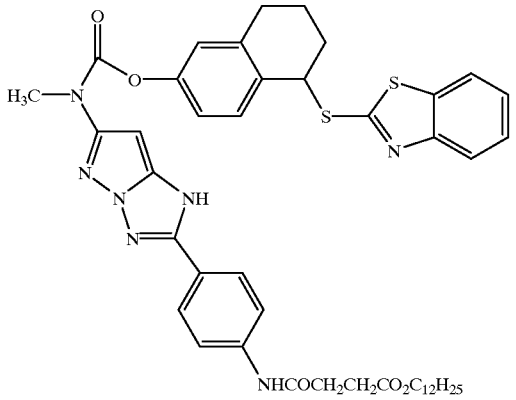
(25)
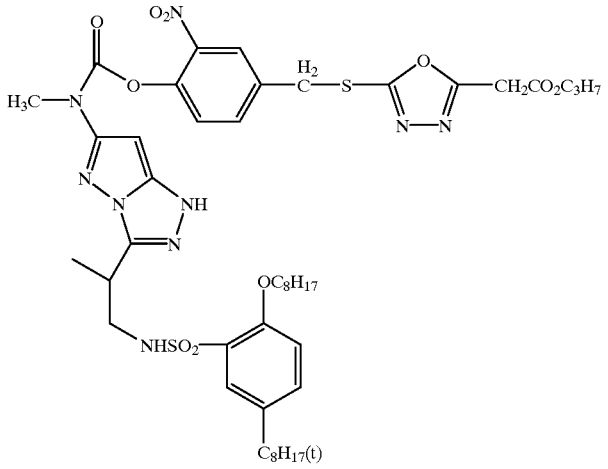
(26)
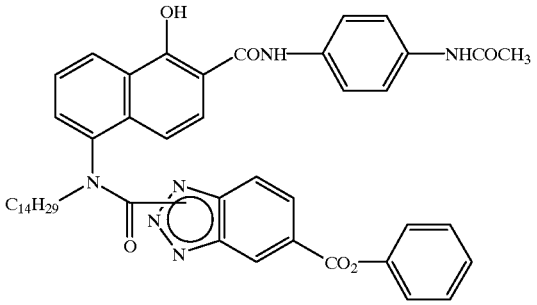
(27)
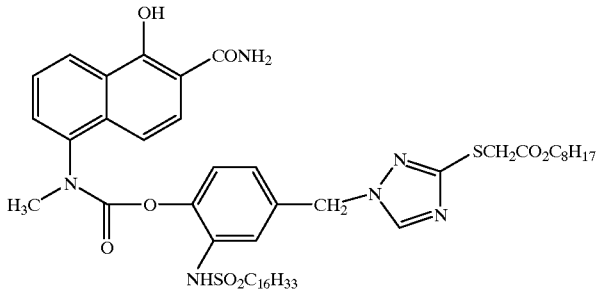

-continued
(28)
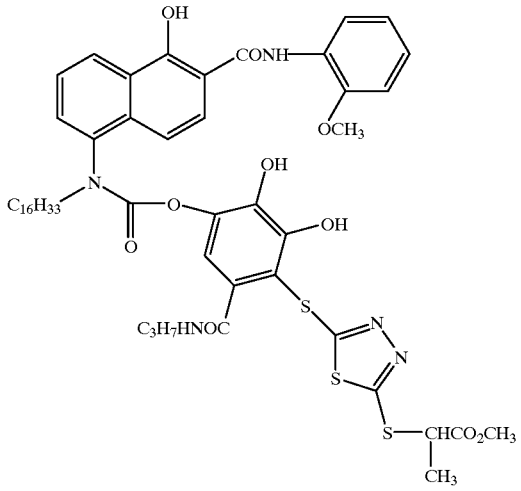
(29)
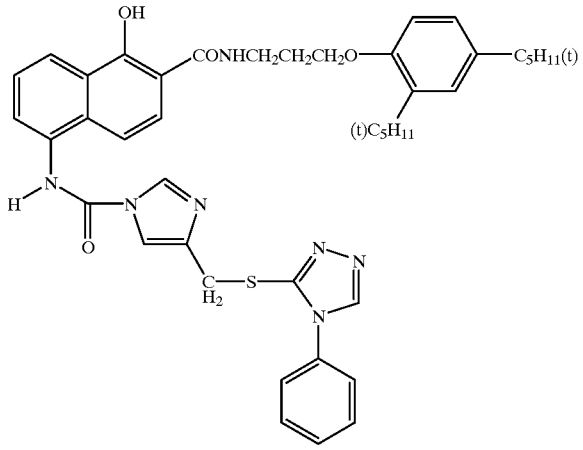
(30)
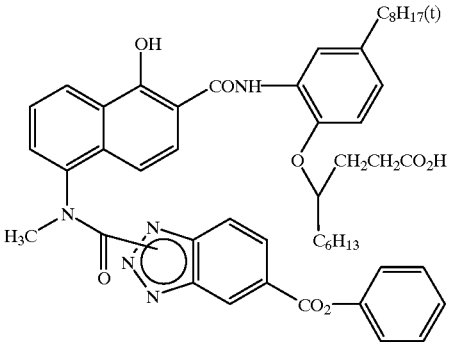

-continued
(31)
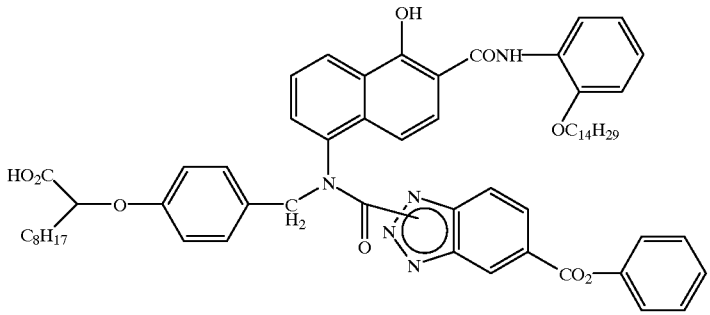
(32)
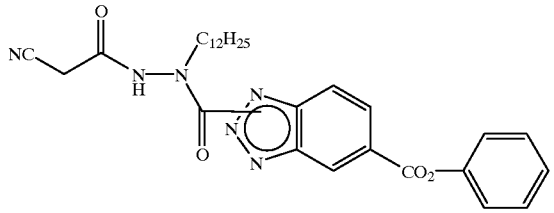
(33)
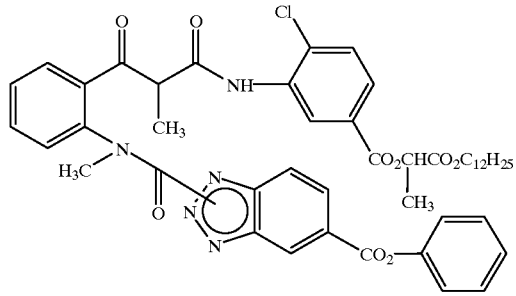
(34)
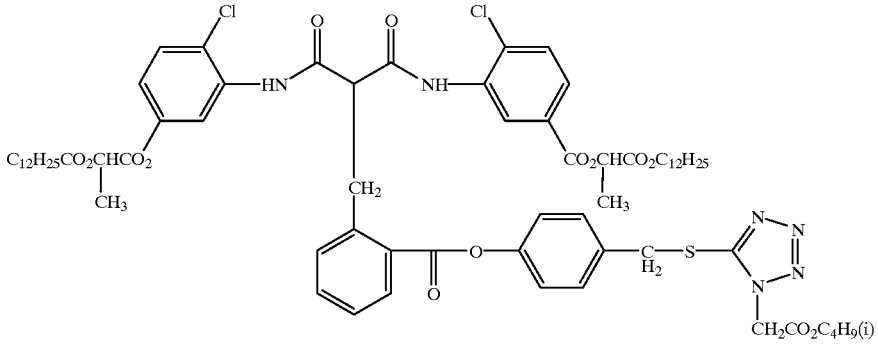
(35)
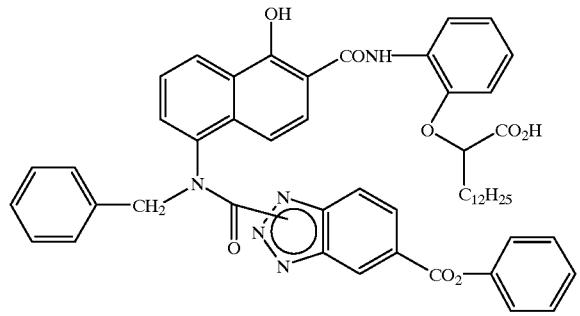

-continued
(36)
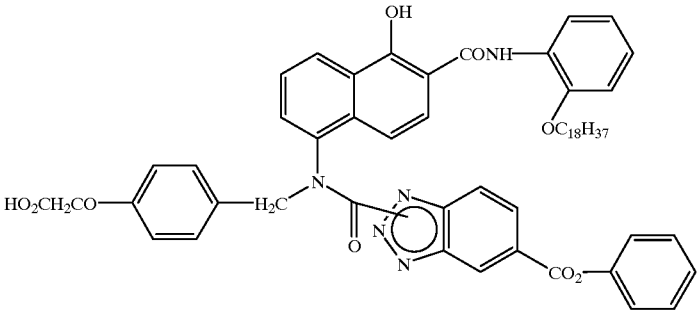
(37)
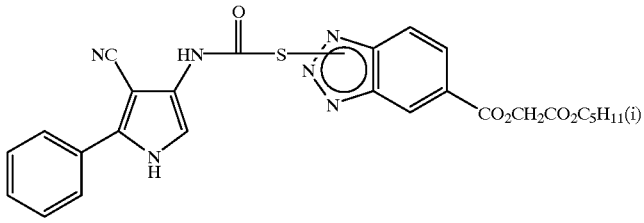
(38)
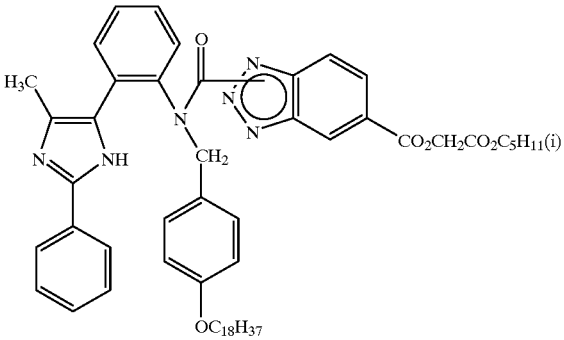
(39)
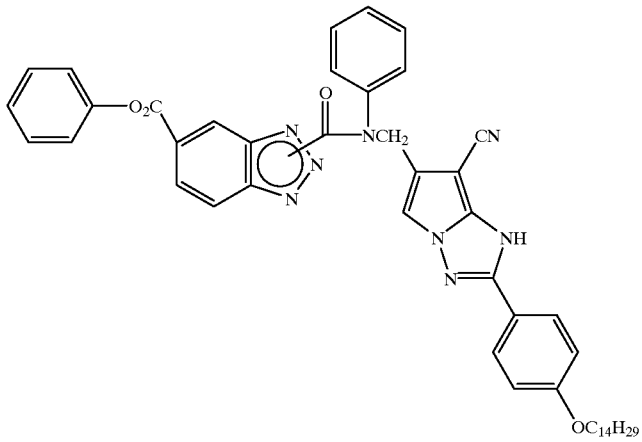

-continued
(40)
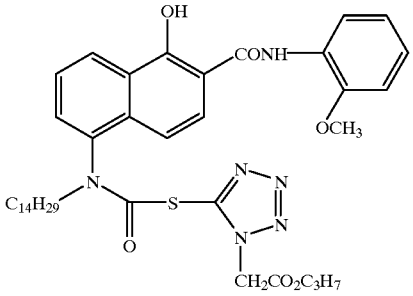
(41)
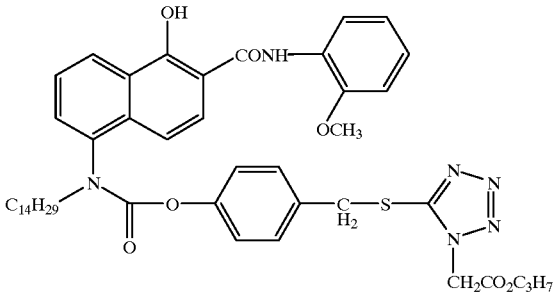
(42)
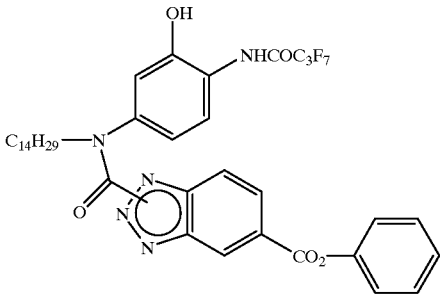
(43)
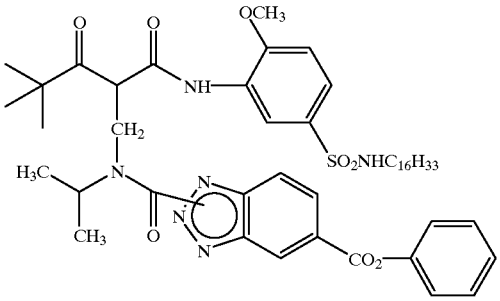
(44)
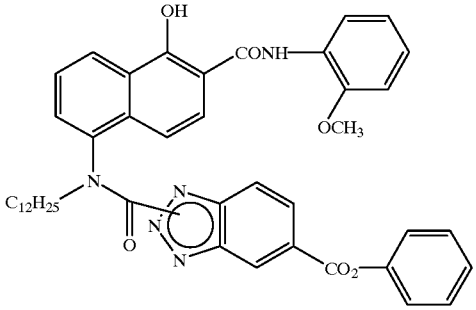

-continued
(45)
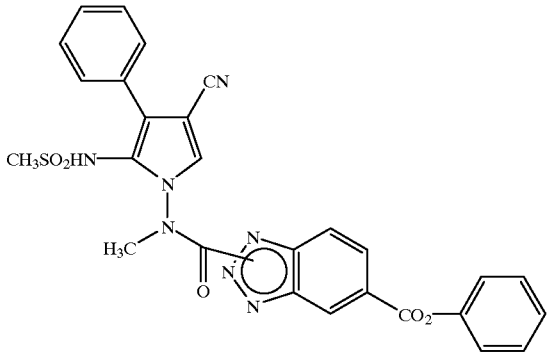
(46)
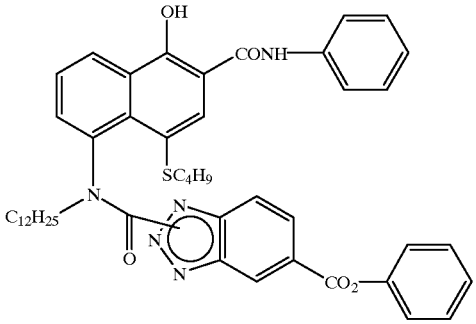
(47)
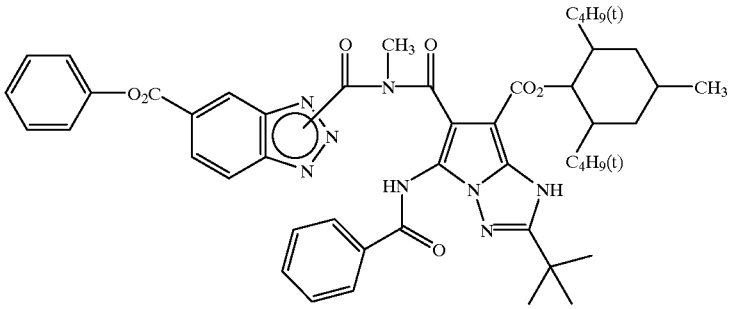
(48)
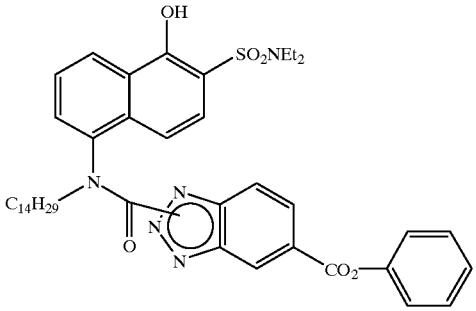

-continued
(49)
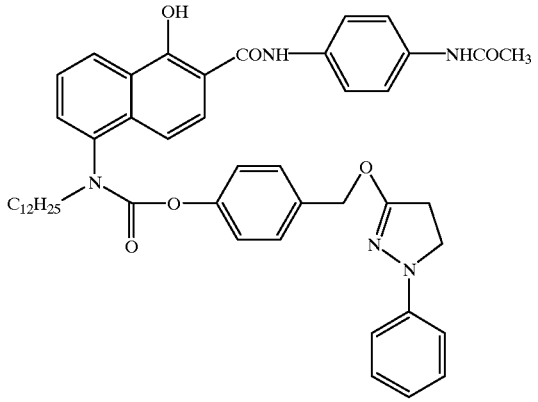
(50)
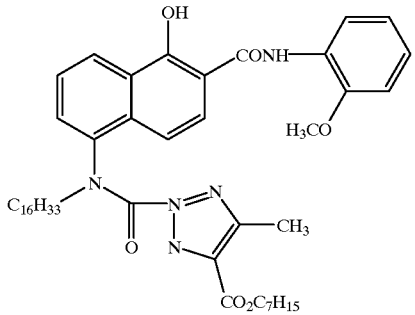
(51)
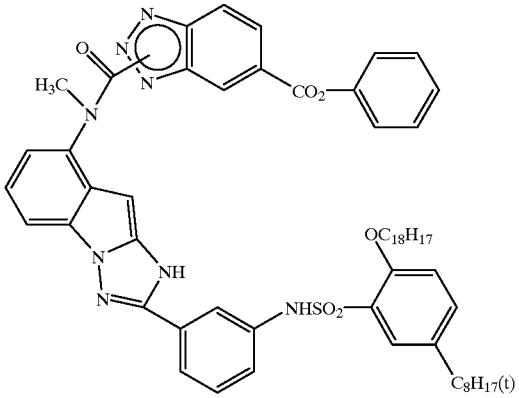
(52)
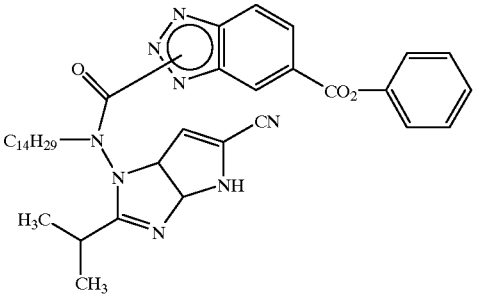
(53)
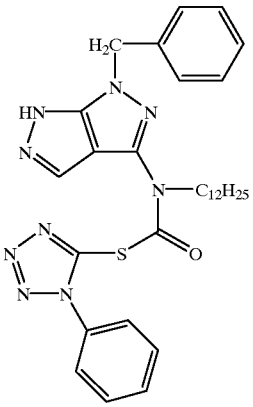
(54)
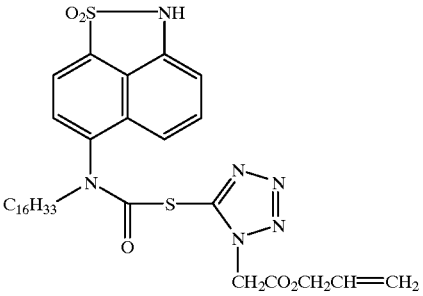

-continued
(55)
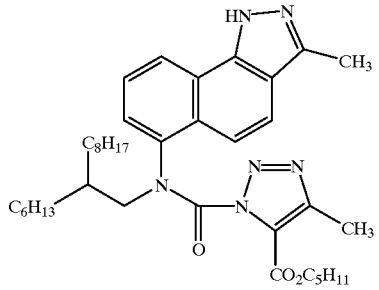
(56)
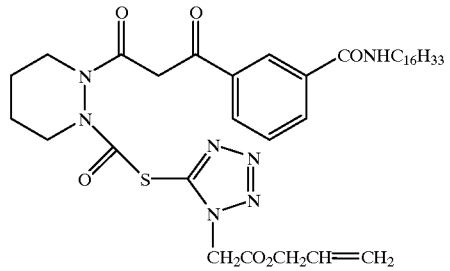
(57)
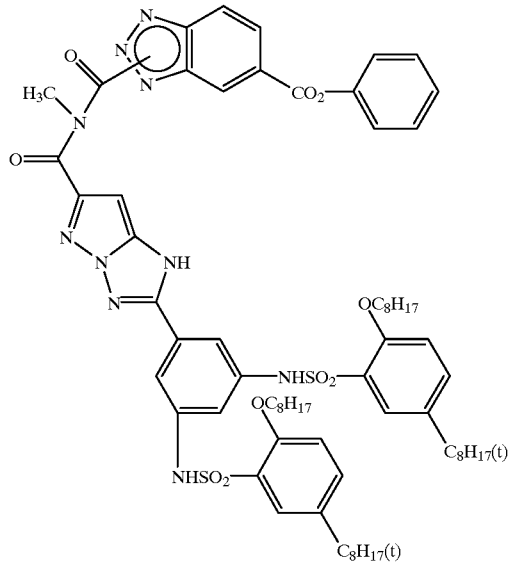
(58)
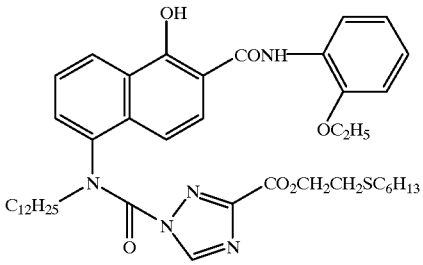
(59)
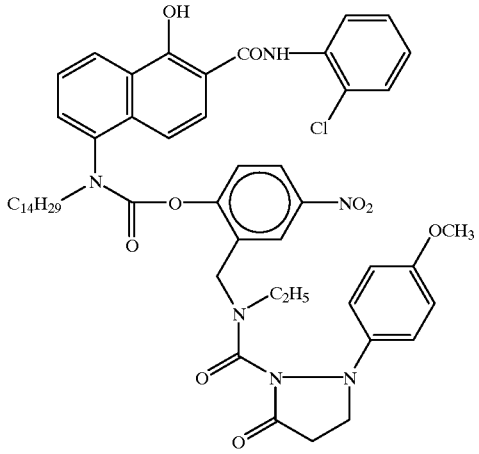
(60)
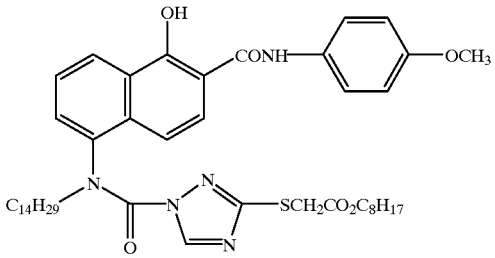
Practical examples of synthesis the compound represented by formula (I) of the present invention will be described below. Synthesis of coupler of the compound example (3)
A coupler of the compound example (3), set forth above was synthesized in accordance with the following scheme Synthesis of exemplified compound (3)

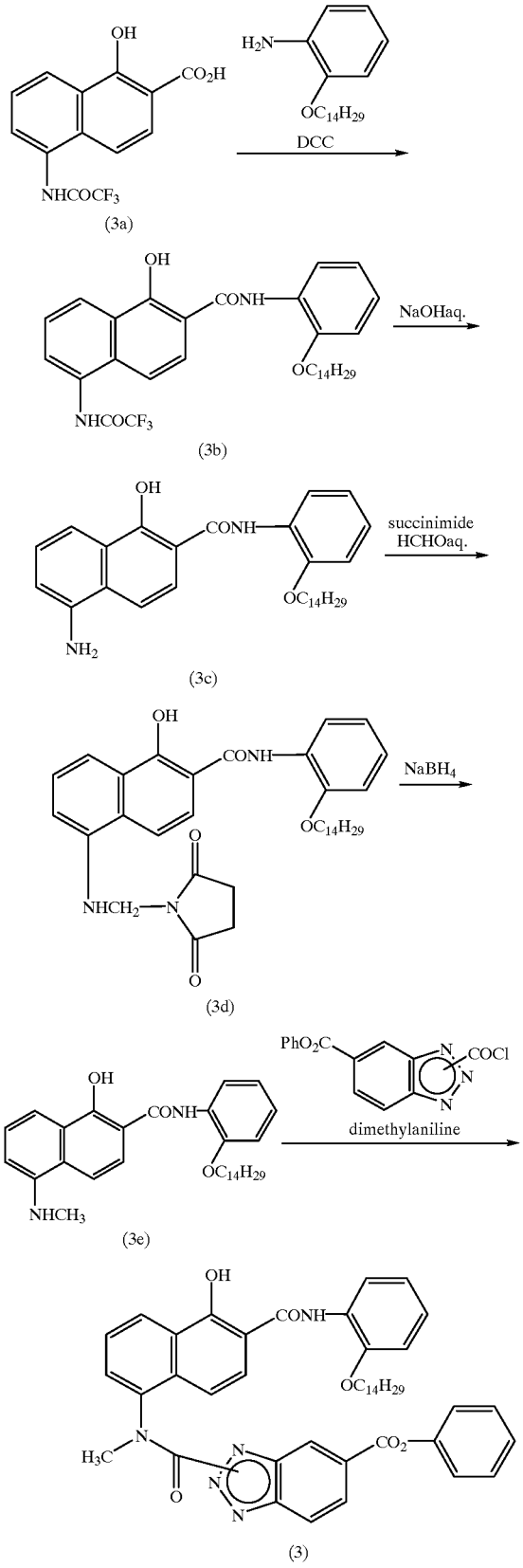

Synthesis of compound 3b

An N,N-dimethylacetamide (60 milliliters (to be referred to as "mL" hereinafter) solution of dicyclohexylcarbodiamide (41.3 g) was dropped into an N,N-dimethylacetamide (250 mL) solution of a compound 3a (50 g) and o-tetradecyloxyaniline (51.1 g) at 30° C. After the reaction solution was stirred at 50° C. for 1 hr, ethyl acetate (250 mL) was added, and the resultant solution was cooled to 20° C. The reaction solution was filtered by suction, and 1N hydrochloric acid aqueous solution (250 mL) was added to the filtrate to separate it. Hexane (100 mL) was added to the organic layer, and the separated crystals were filtered out, washed with acetonitrile, and dried to obtain a compound 3b (71 g).

Synthesis of compound 3c

An aqueous solution (150 mL) of sodium hydroxide (30 g) was dropped into a methanol (350 mL)/tetrahydrofuran (70 mL) solution of the compound 3b (71 g). The resultant solution was stirred in a nitrogen atmosphere at 60° C. for 1 hr. After the reaction solution was cooled to 20° C., concentrated hydrochloric acid was dropped until the system became acidic. The separated crystals were filtered out, washed with water and followed by acetonitrile, and dried to obtain a compound 3c (63 g).

Synthesis of compound 3d

An ethanol solution (150 mL) of the compound 3c (20 g), succinic acid imide (5.25 g), and an aqueous 37% formalin solution (4.3 mL) was stirred under reflux for 5 hrs. After the resultant solution was cooled to 20° C., the separated crystals were filtered out and dried to obtain a compound 3d (16 g).

Synthesis of compound 3e

Sodium boron hydride (1.32 g) was slowly added to a dimethylsulfoxide (70 mL) solution of the compound 3d (7 g) at 60° C. such that the temperature did not exceed 70° C. The resultant solution was stirred at the same temperature for 15 min. After the reaction solution was slowly added to 1N hydrochloric acid aqueous solution (100 mL), ethyl acetate (100 mL) was added for extraction. The organic layer was washed with water, dried by magnesium sulfate, and condensed at reduced pressure. After a placing point component was removed by a short-passage column (developing solvent: ethyl acetate/hexane=2/1), the resultant material was recrystallized from the ethyl acetate/hexane system to obtain a compound 3e (3.3 g).

Synthesis of compound (3)

A dichloromethane (100 mL)/ethyl acetate (200 mL) solution of phenoxycarbonylbenzotriazole (4.78 g) and N,N-dimethylaniline (2.42 g) was dropped into a dichloromethane (80 mL) solution of bis(trichloromethyl) carbonate (1.98 g). The resultant solution was stirred at 20° C. for 2 hrs (solution S). 120 mL of this solution S were dropped into a tetrahydrofuran (20 mL)/ethyl acetate (20 mL) solution of the compound 3e (2.0 g) and dimethylaniline (0.60 g). The resultant solution was stirred at 20° C. for 2 hrs. After the reaction solution was slowly added to 1N hydrochloric acid aqueous solution (200 mL), ethyl acetate (200 mL) was added for extraction. The organic layer was washed with water, dried by magnesium sulfate, and concentrated at reduced pressure. The resultant material was purified through a column (developing solvent: ethyl acetate/hexane=1/5) and recrystallized from the ethyl acetate/hexane system to obtain a compound example (3) weighing 1.3 g (m.p.=138 to 140° C.) (the compound was identified by elementary analysis, NMR, and mass spectrum).

Synthesis of coupler of the compound example (6)

A coupler of the compound example (6), set forth above was synthesized in accordance with the following scheme Synthesis of exemplified compound (6)

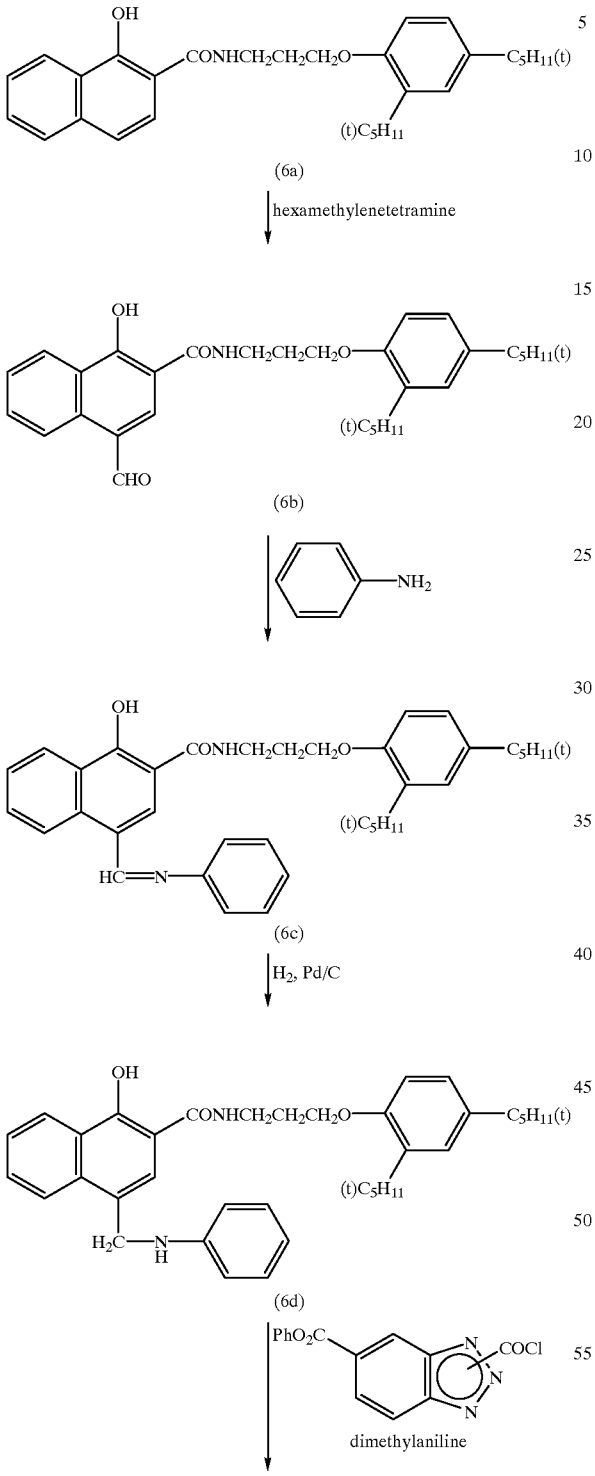

-continued

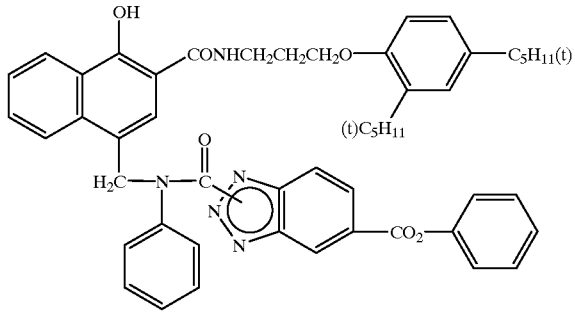

(6)

Synthesis of compound 6b

A compound 6a (23.1 g), hexamethylenetetramine (7.1 g), and $Na_2SO_3$ (6.3 g) were stirred in glacial acetic acid (150 mL) at 90° C. for 4 hrs. After the resultant solution was cooled to 20° C., the separated crystals were filtered out, washed with a small amount of methanol, and dried to obtain a compound 6b (19.8 g).

Synthesis of compound 6d

A toluene (200 mL) solution of the compound 6b (15.0 g) and aniline (3.0 g) was stirred under reflux for 5 hrs while water was removed. After the resultant material was cooled to 20° C., ethyl acetate (100 mL) was added, and the material was dried by magnesium sulfate and concentrated at reduced pressure to obtain a coarse compound 6c. 10%-Pd/C (5 g) and ethyl acetate (200 mL) were added to this coarse compound 6c, and the material was stirred in a 20 kg/cm$^2$ hydrogen atmosphere at room temperature for 3 hrs. The catalyst was filtered away, and the resultant material was concentrated at reduced pressure. The concentrated residue was recrystallized from the ethyl acetate/hexane system to obtain a compound 6d (13.0 g).

Synthesis of compound (6)

The solution S (100 mL) described above was dropped into an ethyl acetate (10 mL) solution of the compound 6d (2.5 g) and N,N-dimethylaniline (0.55 g) at 10° C. The resultant solution was stirred at 20° C. for 2 hrs. The reaction solution was slowly added to 1N hydrochloric acid aqueous solution (200 mL), and ethyl acetate (200 mL) was added for extraction. The organic layer was washed with water, dried by magnesium sulfate, and concentrated at reduced pressure. The resultant material was purified through a column (developing solvent: ethyl acetate/hexane=1/3) and recrystallized from the ethyl acetate/hexane system to obtain a compound example (6) weighing 2.3 g (m.p.=150 to 152° C.) (the compound was identified by elementary analysis, NMR, and mass spectrum).

Synthesis of coupler of the compound example (16)

A coupler of the compound example (16), set forth above was synthesized in accordance with the following scheme Synthesis of exemplified compound (16)

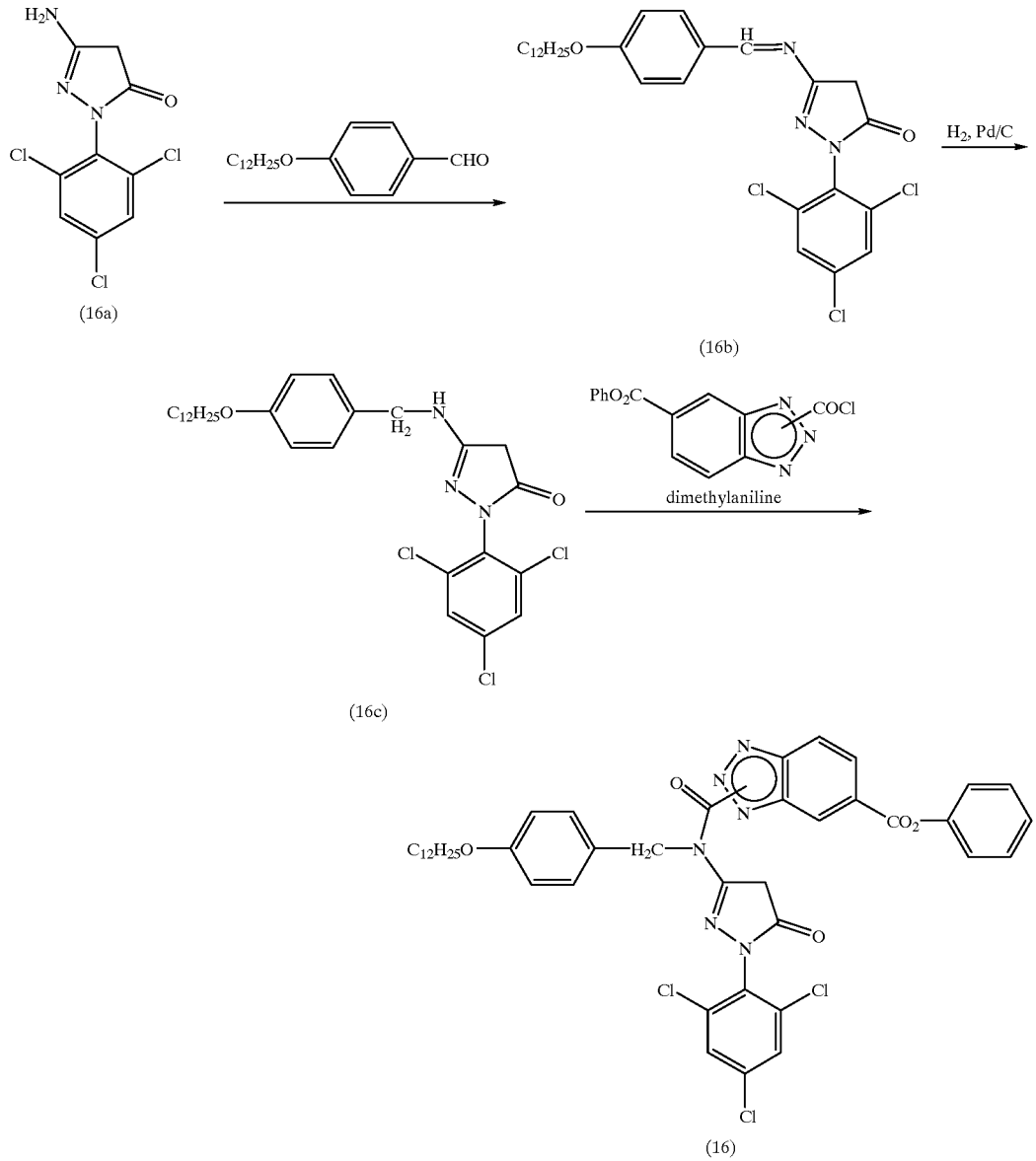

Synthesis of compound 16b

A compound 16a (27.8 g) and p-dodecyloxybenzaldehyde (29 g) were stirred in a nitrogen flow at 120° C. for 1 hr, and the resultant material was cooled to room temperature. The reaction residue was purified through a column (developing solvent: ethyl acetate/hexane=1/3) to obtain a compound 16b (17.3 g).

Synthesis of compound 16c

10%-Pd/C (4 g) and ethyl acetate (250 mL) were added to the compound 16b (17.3 g), and the material was stirred in a 20 kg/cm$^2$ hydrogen atmosphere at room temperature for 3 hrs. The catalyst was filtered away, and the resultant material was concentrated at reduced pressure. The concentrated residue was recrystallized from the ethyl acetate/hexane system to obtain a compound 16c (12.5 g).

Synthesis of compound (16)

200 mL of the solution S were dropped into a tetrahydrofuran (30 mL)/ethyl acetate (30 mL) solution of the compound 16c (4.4 g) and N,N-dimethylaniline (1.1 g). The resultant solution was stirred at 20° C. for 2 hrs. After the reaction solution was slowly added to 1N hydrochloric acid aqueous solution (250 mL), ethyl acetate (250 mL) was added for extraction. The organic layer was washed with water, dried by magnesium sulfate, and concentrated at reduced pressure. The resultant material was purified through a column (developing solvent: ethyl acetate/hexane=1/5) to obtain a compound example (16) weighing 2.9 g. (The compound was identified by elementary analysis, NMR, and mass spectrum).

Synthesis of coupler of the compound example 39

A coupler of the compound example (39), set forth above was synthesized in accordance with the following scheme Synthesis of exemplified compound (39)

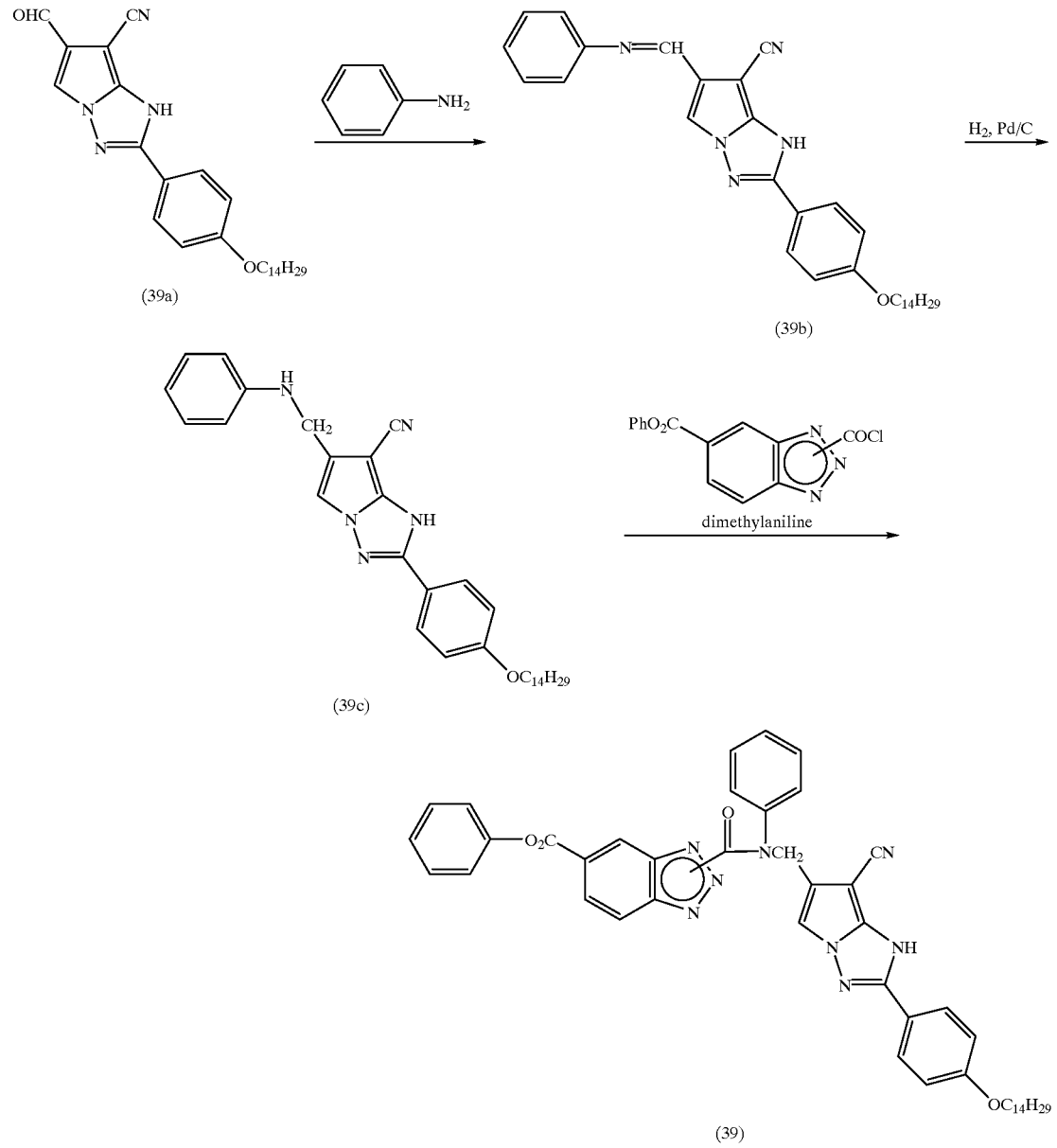

Synthesis of compound 39c

A toluene (200 mL) solution of a compound 39a (15.9 g) and aniline (3.0 g) was stirred under reflux for 5 hrs while water was removed. The resultant material was cooled to 20° C. and concentrated at reduced pressure to obtain a coarse compound 39b. 10%-Pd/C (5 g) and ethyl acetate (200 mL) were added to this coarse compound 39b, and the material was stirred in a 20 kg/cm$^2$ hydrogen atmosphere at room temperature for 5 hrs. The catalyst was filtered away, and the resultant material was concentrated at reduced pressure. The concentrated residue was recrystallized from the ethyl acetate/hexane system to obtain a compound 39c (11.5 g).

Synthesis of compound (39)

A tetrahydrofuran (75 mL) solution of phenoxycarbonylbenzotriazole (19.1 g) was dropped into an ethyl acetate solution (100 mL) of bis(trichloromethyl) carbonate (9.5 g) at 10° C. The resultant solution was stirred at 40° C. for 3 hrs. After the solvent was distilled away at reduced pressure, 200 mL of hexane were added to the concentrated residue, and the material was stirred for 1 hr. The crystals were filtered out and dried to obtain carbamoyl chloride of phenoxycarbonylbenzotriazole (to be abbreviated as PBT-COCl hereinafter) (22.4 g).

This PBT-COCl (3.0 g) was slowly added to a tetrahydrofuran (50 mL) solution of the compound 39c (5.0 g) and N,N-dimethylaniline (2.0 g) at 10° C. The resultant solution was stirred at 20° C. for 2 hrs. The reaction solution was slowly added to ethyl acetate (200 mL)/1N hydrochloric acid aqueous solution (200 mL). The organic layer was washed with water, dried by magnesium sulfate, and concentrated at reduced pressure. The concentrated residue was purified through a column (developing solvent: ethyl acetate/hexane=1/4) to obtain a compound example (39) weighing 3.2 g. (The compound was identified by elementary analysis, NMR, and mass spectrum.)

Synthesis of coupler of the compound example (40)

A coupler of the compound example (40), set forth above was synthesized in accordance with the following scheme Synthesis of exemplified compound (40)

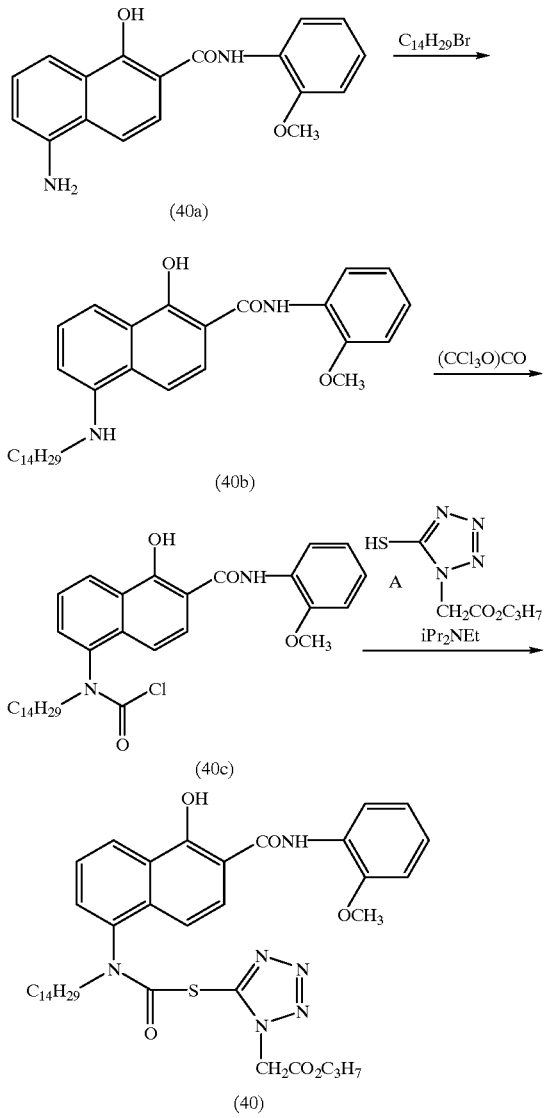

Synthesis of compound 40b

A 1-methylpyrrolidone (150 mL) solution of a compound 40a (50 g) synthesized following the same procedure as for the compound 3c and bromotetradecane (78.6 g) was stirred at 120° C. for 5 hrs. The resultant solution was cooled to 25° C. and poured into ethyl acetate (600 mL)/water (600 mL). The organic layer was washed with water and concentrated at reduced pressure. The concentrated residue was recrystallized from the ethyl acetate/hexane system to obtain a compound 40b (48 g).

Synthesis of compound 40C

A tetrahydrofuran (20 mL) solution of a compound 41b (6.5 g) and dimethylaniline (3.1 g) was dropped into a tetrahydrofuran (5 mL) solution of bis(trichloromethyl) carbonate (1.9 g) at 10° C. The reaction solution was stirred at 25° C. for 1 hr and poured into ethyl acetate (100 mL)/1N hydrochloric acid aqueous solution (100 mL). The organic layer was washed with water, dried by magnesium sulfate, and concentrated at reduced pressure. The concentrated residue was recrystallized from the ethyl acetate/hexane system to obtain a compound 40c (5.4 g).

Synthesis of compound (40)

A toluene (50 mL) solution of the compound 40c (3.0 g), a mercaptotetrazole derivative A (2.1 g), and N,N-diisopropyl-N-ethylamine (1.2 g) was stirred at 80° C. for 5 hrs. The reaction solution was cooled to 30° C. and poured into ethyl acetate (100 mL)/sodium bicarbonate water (100 mL). The organic layer was washed with water, dried by magnesium sulfate, and concentrated at reduced pressure. The concentrated residue was purified through a column (developing solvent: ethyl acetate/hexane=1/2) to obtain a compound example (40) weighing 2.5 g (the compound was identified by elementary analysis, MNR, and mass spectrum).

Synthesis of coupler of the compound example (41)

A coupler of the compound example (41), set forth above was synthesized in accordance with the following scheme Synthesis of exemplified compound (41)

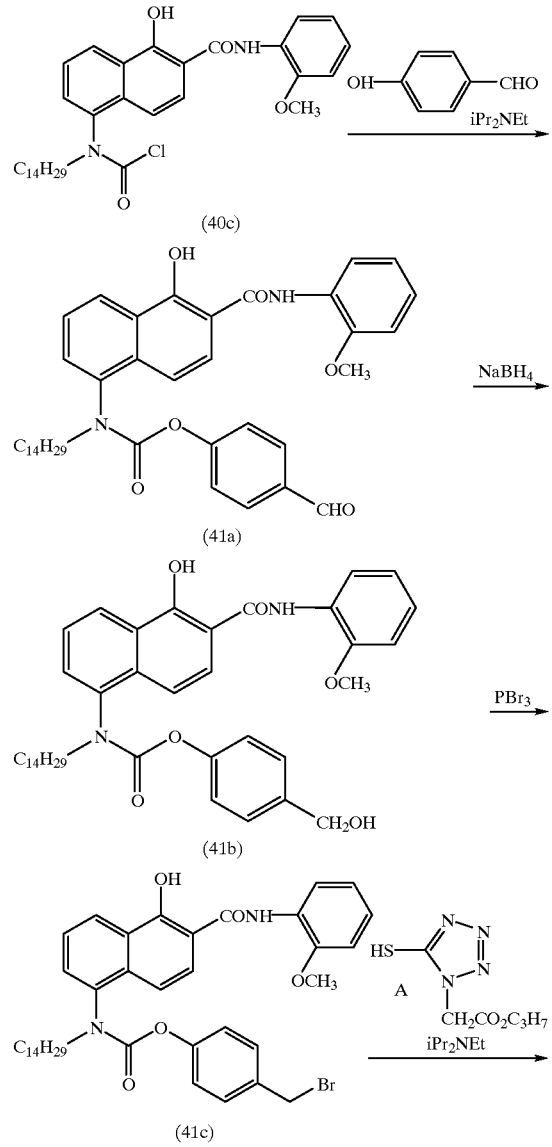

-continued

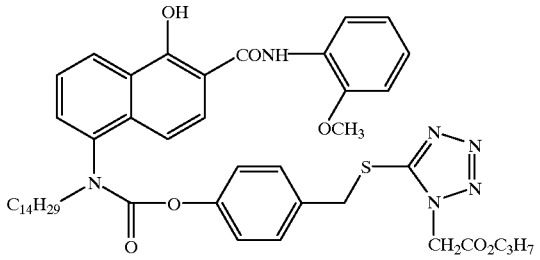

(41)

Synthesis of compound 41a

A toluene (100 mL) solution of the compound 40c (4.5 g), p-hydroxybenzaldehyde (5.0 g), and N,N-diisopropyl-N-ethylamine (4.8 g) was stirred under reflux for 5 hrs. The reaction solution was cooled to 30° C. and poured into ethyl acetate (500 mL)/sodium bicarbonate water (500 mL). The organic layer was washed with water, dried by magnesium sulfate, and concentrated at reduced pressure. The concentrated residue was purified through a column (developing solvent: ethyl acetate/hexane=1/3) to obtain a compound 41a (3.8 g).

Synthesis of compound 41b

Sodium boron hydroxide (0.48 g) was added to a methanol (100 mL)/tetrahydrofuran (20 mL) solution of the compound 41a (3.8 g) at 25° C., and the solution was stirred for 1 hr. The reaction solution was poured into ethyl acetate (100 mL)/1N hydrochloric acid aqueous solution (100 mL). The organic layer was washed with water, dried by magnesium sulfate, and concentrated at reduced pressure. The concentrated residue was purified through a column (developing solvent: ethyl acetate/hexane=1/2) to obtain a compound 41b (3.7 g).

Synthesis of compound 41c

Phosphorous tribromide (0.7 g) was added to a dichloromethane (20 mL) solution of the compound 41b (3.5 g) at 10° C., and the solution was stirred for 1 hr. The reaction solution was poured into ethyl acetate (100 mL)/1N hydrochloric acid aqueous solution (100 mL). The organic layer was washed with water, dried by magnesium sulfate, and concentrated at reduced pressure. The concentrated residue was purified through a column (developing solvent: ethyl acetate/hexane=1/4) to obtain a compound 41c (2.8 g).

Synthesis of compound 41

An N,N-dimethylacetamide (10 mL) solution of the compound 41c (2.5 g), mercaptotetrazole derivative A (1.7 g), and N,N-diisopropyl-N-ethylamine (1.0 g) was stirred at 25° C. for 2 hrs. The reaction solution was poured into ethyl acetate (100 mL)/sodium bicarbonate water (100 mL). The organic layer was washed with water, dried by magnesium sulfate, and concentrated at reduced pressure. The concentrated residue was purified through a column (developing solvent: ethyl acetate/hexane=1/1) to obtain a compound example (41) weighing 1.7 g (the compound was identified by elementary analysis, NMR, and mass spectrum).

Synthesis of coupler of the compound example (42)

A coupler of the compound example (42), set forth above was synthesized in accordance with the following scheme Synthesis of exemplified compound (42)

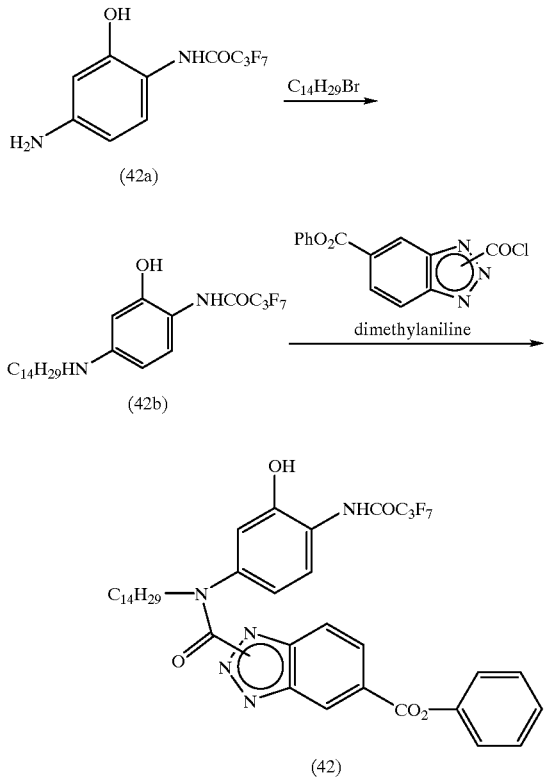

(42)

Synthesis of compound 42b

A 1-methylpyrrolidone (60 mL) solution of a compound 42a (20 g) and bromotetradecane (26 g) was stirred at 120° C. for 5 hrs. The resultant material was cooled to 25° C. and poured into ethyl acetate (400 mL)/water (600 mL). The organic layer was concentrated at reduced pressure. The concentrated residue was purified through a column (developing solvent: ethyl acetate/hexane=1/3) to obtain a compound 42b (9.0 g).

Synthesis of compound (42)

PBT-COCl (2.6 g) described above was slowly added to a tetrahydrofuran (50 mL) solution of the compound 42b (7.2 g) and N,N-dimethylaniline (4.4 g) at 10° C. The resultant solution was stirred at 20° C. for 2 hrs. The reaction solution was slowly added to ethyl acetate (200 mL)/1N hydrochloric acid aqueous solution (200 mL). The organic layer was washed with water, dried by magnesium sulfate, and concentrated at reduced pressure. The concentrated residue was purified through a column (developing solvent: ethyl acetate/hexane=1/3) to obtain a compound example (42) weighing 4.0 g. (The compound was identified by elementary analysis, NMR, and mass spectrum.)

Synthesis of coupler of the compound example (43)

A coupler of the compound example (43), set forth above was synthesized in accordance with the following scheme Synthesis of exemplified compound (43)

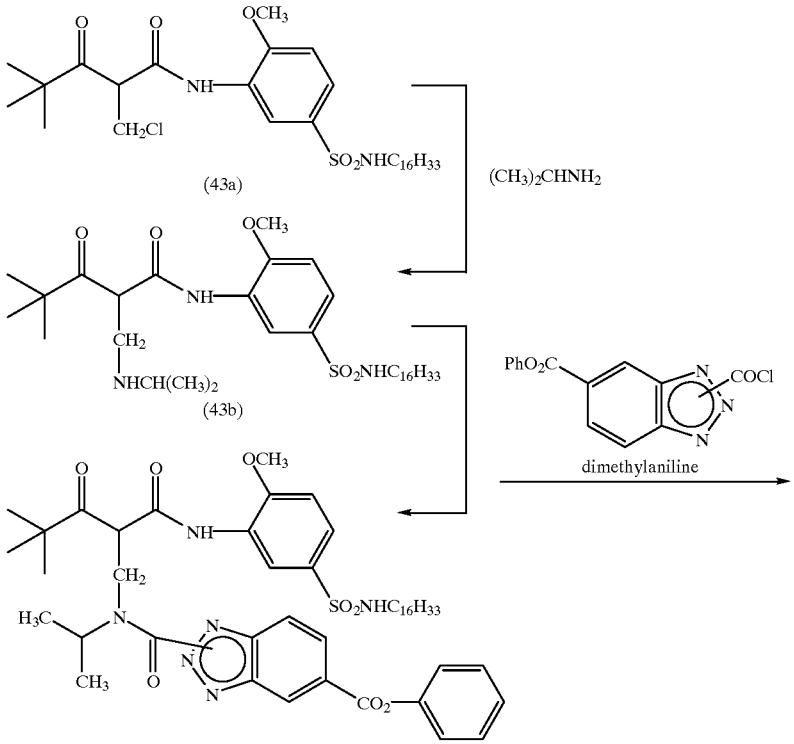

Synthesis of compound 43b

A toluene (200 mL) solution of a compound 43a (20 g) and isopropylamine (20 g) was stirred with heating, then concentrated at reduced pressure. The concentrated residue was purified through a column (developing solvent: ethyl acetate/hexane=1/2) to obtain a compound 43b (7.6 g).

Synthesis of compound (43)

PBT-COCl (2.9 g) was slowly added to a tetrahydrofuran (50 mL) solution of the compound 43b (5.0 g) and N,N-dimethylaniline (1.5 g) at 10° C. The resultant solution was stirred at 25° C. for 2 hrs. The reaction solution was slowly added to ethyl acetate (200 mL)/1N hydrochloric acid aqueous solution (200 mL). The organic layer was washed with water, dried by magnesium sulfate, and concentrated at reduced pressure. The concentrated residue was purified through a column (developing solvent: ethyl acetate/hexane=1/2) to obtain a compound example (43) weighing 3.2 g. (The compound was identified by elementary analysis, NMR, and mass spectrum.)

Synthesis of coupler of the compound example (44)

A coupler of the compound example (44), set forth above was synthesized in accordance with the following scheme Synthesis of exemplified compound (44)

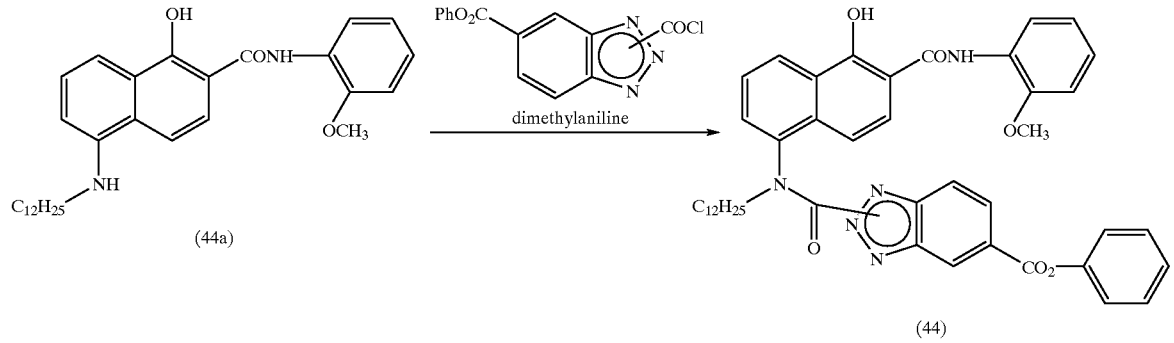

Synthesis of compound (44)

PBT-COCl (6.6 g) was slowly added to a tetrahydrofuran (100 mL) solution of a compound 44a (10.0 g) synthesized following the same procedure as for the compound 40b and N,N-dimethylaniline (2.9 g) at 10° C. The resultant solution was stirred at 20° C. for 2 hrs. The reaction solution was slowly added to ethyl acetate (300 mL)/1N hydrochloric acid aqueous solution (300 mL). The organic layer was washed with water, dried by magnesium sulfate, and concentrated at reduced pressure. The concentrated residue was purified through a column (developing solvent: ethyl acetate/hexane=1/4) to obtain a compound example (44) weighing 7.9 g (m.p.=99 to 103° C.) (the compound was identified by elementary analysis, NMR, and mass spectrum).

When used in place of a conventional dye-forming DIR coupler, the compound represented by formula (I) can solve the problems resulting from formation of a dye, e.g., unpreferable color impurity, deterioration of image stability, and bleach stain. Also, this compound can reduce the mask density when used in place of a colored coupler which is used to obtain an apparent interlayer effect. The use amount of this coupler is limited because the coupler increases the main coupler amount in image formation to lead to an increase in cost. However, a use amount of the compound represented by formula (I) is preferably as large as possible in order to improve the photographic properties described earlier. For example, in a layer containing a colored coupler, the amount of the colored coupler can be reduced by the addition of the compound represented by formula (I) of the invention, thereby the addition amount of the compound represented by formula (I) can be increased. Specifically, the value, X/(X+Y), can be significantly larger than 0.14. Preferably, the amount of the compound represented by formula (I) of the invention meets the relation: $X/(X+Y) \geqq 0.14$, wherein X is the molar amount of the compound represented by formula (I) of the invention and Y is the molar amount of at least one functional coupler other than the compound represented by formula (I) of the invention which is contained in the same color-sensitive layer as that to which the compound represented by formula (I) of the invention is added or in the color-sensitive layers having the same color sensitivity as the light-sensitive layer to which the compound represented by formula (I) of the invention is added, or in the same non-sensitive layer as that to which the compound represented by formula (I) of the invention is added. Specifically, in the case where the compound represented by formula (I) of the invention is added to a light-sensitive layer, "in the same color-sensitive layer" mentioned above means the layer to which the compound represented by formula (I) of the invention is added. If the light-sensitive layer comprises a plurality of light-sensitive sub-layers having the same spectral sensitivity but having different speeds and the compound represented by formula (I) of the invention is added to at least one of the sub-layers, the amount of Y is that contained in the color-sensitive sub-layers having the same spectral sensitivity as the sub-layer to which the compound represented by formula (I) of the invention is added. For example, in the case where the compound represented by formula (I) of the invention is added to at least one blue sensitive sub-layer, Y is the amount of at least one functional coupler other than the compound represented by formula (I) of the invention contained in all the blue sensitive sub-layers. Similarly, in the case where the compound represented by formula (I) of the invention is added to at least one green sensitive sub-layer, Y is the amount of at least one functional coupler other than the compound represented by formula (I) of the invention contained in all the green sensitive sub-layers. In the case where the compound represented by formula (I) is added to a non-sensitive layer, "in the same non-sensitive layer" means the non-sensitive layer to which the compound represented by formula (I) of the invention is added. In the present invention the value, X/(X+Y), is more preferably 0.30 or more, and much more preferably 0.50 or more. Also, in the photographic material of the invention, the functional coupler other than the compound represented by formula (I) of the invention may not be added, i.e., Y=0 is possible. If this is the case, the value, X/(X+Y), is 1.

A development inhibitor releasing compound represented by formula (I) of the present invention can be used in any layer of the sensitive material of the invention. That is, this development inhibitor releasing compound can be used in at least any one of sensitive layers (blue-, green-, and red-sensitive layers, and an interlayer effect donor layer (to be also simply referred to as a donor layer hereinafter) having different spectral sensitivity distributions from those of these main sensitive layers) and non-sensitive layers (e.g., a protective layer, yellow filter layer, interlayer, and antihalation layer). When this compound is used in two or more sensitive layers having different spectral sensitivities, preferable combinations are blue-sensitive layer/green-sensitive layer, green-sensitive layer/donor layer, green-sensitive layer/red-sensitive layer, blue-sensitive layer/green-sensitive layer/donor layer, blue-sensitive layer/green-sensitive layer/red-sensitive layer, green-sensitive layer/donor layer/red-sensitive layer, and blue-sensitive layer/green-sensitive layer/donor layer/red-sensitive layer, i.e., all sensitive layers. When a layer sensitive to one color is divided into two or more sub-layers having different sensitivities, the development inhibitor releasing compound can be added to any or all of highest-, lowest-, and medium-sensitive layers. A development inhibitor releasing compound is preferably added to a sensitive layer and/or a non-sensitive layer adjacent to the sensitive layer.

The coating amount of the development inhibitor releasing compound represented by formula (I) in the sensitive material of the invention is $5\times10^{-4}$ to 2 g/m$^2$, preferably $1\times10^{-3}$ to 1 g/m$^2$, and more preferably $5\times10^{-3}$ to $5\times10^{-1}$ g/m$^2$.

A development inhibitor releasing compound represented by formula (I) can be added to a sensitive material by using any known dispersion method suited to the compound. For example, if a compound is soluble in alkali, the compound can be added as an aqueous alkaline solution or as a solution prepared by dissolving the compound in an organic solvent miscible with water. Alternatively, the compound can be added by an oil-in-water dispersion method using a high-boiling-point organic solvent or by a solid dispersion method.

A development inhibitor releasing compound represented by formula (I) can be used singly, or two or more types of compounds can be used together. The same compound can also be used in two or more layers. Furthermore, these development inhibitor releasing compounds can be used together with other known development inhibitor releasing compounds or development inhibitor precursor releasing compounds and can coexist with couplers and other additives (to be described later). These compounds are properly selected in accordance with the properties required of a sensitive material.

A development inhibitor releasing compound represented by formula (I) of the present invention releases a development inhibitor by coupling with an oxidized form of a developing agent. However, a nucleus (A in the explanation of formula (I)) of this compound does not form a dye and remains as a compound which does not leave a color image in the sensitive material.

The development inhibitor releasing compound represented by formula (I) of the present invention, therefore, can be advantageously used in any layer constructing a sensitive material, e.g., any of red-, green-, and blue-sensitive layers, in accordance with the properties required of the sensitive material. Additionally, the compound represented by formula (I) forms a compound which does not leave a color image, and this compound formed remains in a sensitive material. Hence, a compound represented by formula (I) is advantageous in that the compound does not flow out into a processing solution to pollute the solution.

Functional couplers other than a compound represented by formula (I) defined in the present invention are couplers for correcting unnecessary absorption of a color dye and couplers, except for the compound represented by formula (I), which release a photographically useful group. However, these functional couplers in the present invention do not include "non-dye-forming couplers" and "flow couplers" mentioned earlier.

When functional couplers are used in the same color-sensitive layer or in the same non-sensitive layer to which a compound represented by formula (I) is added, these functional couplers are preferably couplers for correcting unnecessary absorption of a color dye, and more preferably couplers for releasing a development inhibitor.

Couplers for correcting unnecessary absorption of a colored dye are preferably yellow colored cyan couplers (particularly YC-86 on page 86) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; compound (2) (column. 8) in U.S. Pat. No. 4,837,136; and colorless masking couplers (particularly compound examples on pages 36 to 45) represented by formula (A) in claim 1 of WO92/11575, all the disclosures of which are herein incorporated by reference.

Examples of the coupler which releases a photographically useful group are as follows. Development inhibitor-releasing compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand-releasing compounds: compounds (particularly compounds in column 12, lines 21 to 41) represented by LIG-X described in claim 1 of U.S. Pat. No. 4,555,478; leuco dye-releasing compounds: compounds 1 to 6 in columns 3 to 8 of U.S. Pat. No. 4,749,641; fluorescent dye-releasing compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, all the disclosures of which are herein incorporated by reference.

These functional couplers can also be used in photographic layers other than the same color-sensitive layer or the same non-sensitive layer to which a compound represented by formula (I) is added.

The barycentric wavelength $\lambda_{-R}$ Of the wavelength distribution of the magnitude of an interlayer effect given to a red-sensitive silver halide emulsion layer (RL) from another silver halide emulsion layer at a wavelength of 500 to 600 nm is obtained as follows.

(1) First, by using a red filter which transmits wavelengths higher than a specific wavelength or an interference filter which transmits the specific wavelength such that a red-sensitive layer for generating cyan at a wavelength of 600 nm or more is sensitized and other layers are not sensitized, uniform exposure is given to evenly fog the cyan generating red-sensitive layer to an appropriate value.

(2) Spectral exposure is then performed. Consequently, blue- and green-sensitive layers give a development inhibiting interlayer effect to the fogged red-sensitive emulsion layer, thereby forming a reversal image (FIG. 1A).

(3) From this reversal image, a spectral sensitivity distribution $S_{-R}(\lambda)$ as a reversal sensitive material is obtained. $S_{-R}(\lambda)$ for a specific wavelength $\lambda$ is obtained at a corresponding point of a point a shown in FIG. 1A.

(4) The barycentric wavelength ($\lambda_{-R}$) of the interlayer effect is calculated by equation (L) below Equation (L)

$$\lambda_{-R} = \frac{\int_{500\,\mathrm{nm}}^{600\,\mathrm{nm}} \lambda \cdot S_{-R}(\lambda) d\lambda}{\int_{500\,\mathrm{nm}}^{600\,\mathrm{nm}} S_{-R}(\lambda) d\lambda}$$

Figure 1B:
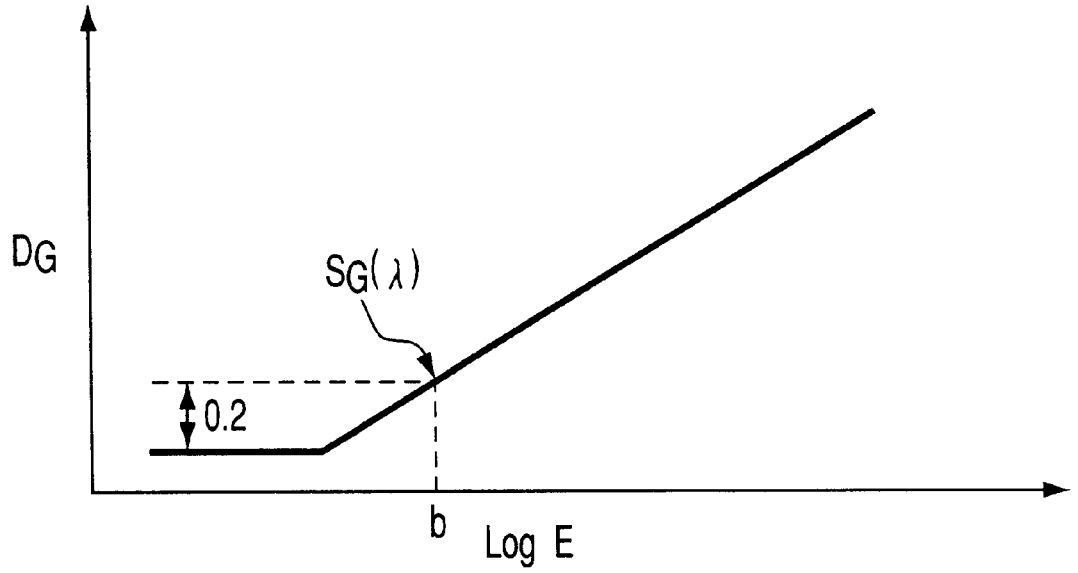
FIG. 1B is a view showing the spectral sensitivity distribution curve of a green-sensitive layer.

The above barycentric wavelength, $\lambda$ G, is given by the following formula:

$$\lambda_G = \frac{\int_{500\,\mathrm{nm}}^{600\,\mathrm{nm}} \lambda \cdot S_G(\lambda) d\lambda}{\int_{500\,\mathrm{nm}}^{600\,\mathrm{nm}} S_G(\lambda) d\lambda},$$

wherein $S_G(\lambda)$ is the spectral sensitivity distribution curve of a green-sensitive layer. A corresponding value of $S_G(\lambda)$ at the specific wavelength $\lambda$ is calculated from a point b shown in FIG. 1B.

In a silver halide color photosensitive material of the present invention, at least one sensitive layer needs only be formed on a support. A typical example is a silver halide photosensitive material having, on a support, at least one sensitive layer consisting of a plurality of silver halide emulsion layers sensitive to essentially the same color but different in sensitivity. This sensitive layer is a unit sensitive layer sensitive to one of blue light, green light, and red light. In a multilayered silver halide color photosensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-sensitive layers can be formed between the silver halide sensitive layers and as the uppermost layer and the lowermost layer. These non-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, high- and low-speed emulsion layers are preferably arranged such that the sensitivity is sequentially decreased toward a support, all the disclosures of which are herein incorporated by reference.

Also, as described in JP-A-57-112751, JP-A-62-200350, JP-A-62-206541, and JP-A-62-206543, layers can be arranged such that a low-speed emulsion layer is formed apart from a support and a high-speed layer is formed close to the support, all the disclosures of which are herein incorporated by reference.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When a layer structure is thus constituted by three layers having different sensitivities, these layers can be arranged, in a layer sensitive to one color, in the order of medium-speed emulsion layer/high-speed emulsion layer/low-speed emulsion layer from the farthest side from a support as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

To improve the color reproduction, an interlayer effect donor layer (CL) having a different spectral sensitivity distribution from that of a main sensitive layer such as BL, GL, or RL is preferably arranged adjacent to or close to this main sensitive layer, as described in U.S. Pat. Nos. 4,663,271, 4,705,744, 4,707,436, JP-A-62-160448, and JP-A-63-89850, all the disclosures of which are herein incorporated by reference.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628, 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table to be presented later.

In a sensitive material of the present invention, it is possible to mix, in a single layer, two or more types of emulsions different in at least one of characteristics of a sensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 μm, and most preferably 0.05 to 0.6 μm. The grain shape can be a regular grain shape. Although the emulsion can be a polydisperse emulsion, it is preferably a monodisperse emulsion (in which at least 95% in weight or number of grains of silver halide grains have grain sizes falling within a range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 μm, and more preferably 0.02 to 2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a sensitive material of the present invention is preferably 6.0 g/m$^2$ or less, and most preferably 4.5 g/m$^2$ or less.

Photographic additives usable in the present invention are also described in RDs, and the relevant portions are summarized in the following table, all the disclosures of which are herein incorporated by reference.

| | Additives | RD17643 | RD18716 |
|---|---|---|---|
| 1. | Chemical sensitizers | page 23 | page 648, right column |
| 2. | Sensitivity increasing agents | | do |
| 3. | Spectral sensitizers, super sensitizers | pages 23–24 | page 648, right column to page 649, right column |
| 4. | Brighteners | page 24 | page 647, right column |
| 5. | Light absorbents, filter dyes, ultraviolet absorbents | pages 25–26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26–27 | do |
| 9. | Antistatic agents | page 27 | do |
| 10. | Matting agents | | |

-continued

| | Additives | RD307105 |
|---|---|---|
| 1. | Chemical sensitizers | page 866 |
| 2. | Sensitivity increasing agents | |
| 3. | Spectral sensitizers, super sensitizers | pages 866–868 |
| 4. | Brighteners | page 868 |
| 5. | Light absorbent, filter dye, ultraviolet absorbents | page 873 |
| 6. | Binders | pages 873–874 |
| 7. | Plasticizers, lubricants | page 876 |
| 8. | Coating aids, surface active agents | pages 875–876 |
| 9. | Antistatic agents | pages 876–877 |
| 10. | Matting agents | pages 878–879 |

Various dye forming couplers can be used in a sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, all the disclosures of which are herein incorporated by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, all the disclosures of which are herein incorporated by reference.

Polymer couplers: P-1 and P-5 (page 11) in JP-A-2-44345, all the disclosures of which are herein incorporated by reference.

Couplers for forming a colored dye with a proper diffusibility are preferably those described in U.S. Pat. No. 4,366,237, GB2,125,570, EP96,873B, and DE3,234,533, all the disclosures of which are herein incorporated by reference.

Preferable examples of additives other than couplers are as follows, all the disclosures of which are herein incorporated by reference.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No.

4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly a compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly a compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A.

The present invention can be applied to various color sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879.

In a sensitive material of the present invention, the total film thickness of all hydrophilic colloid layers on the side having emulsion layers is preferably 28 μm or less, more preferably 23 μm or less, most preferably 18 μm or less, and particularly preferably 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. The film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness−film thickness)/film thickness.

In a sensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The lubrication ratio of the back layers is preferably 150 to 500%.

A color sensitive material according to the present invention can be developed by conventional methods described in RD. No. 17643, pp. 28 and 29, RD. No. 18716, page 615, left to right columns, and RD. No. 307105, pp. 880 and 881.

Color negative film processing solutions used in the present invention will be described below.

Compounds described in JP-A-4-121739, page 9, upper right column, line 1 to page 11, lower left column, line 4 can be used in a color developer of the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl)amino]aniline is preferable.

The use amount of any of these color developing agents is preferably 0.01 to 0.08 mol, more preferably 0.015 to 0.06 mol, and most preferably 0.02 to 0.05 mol per liter (to be referred to as "L" hereinafter) of a color developer. Also, a replenisher of a color developer preferably contains a color developing agent at concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Examples are N,N-di(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di(sulfoethyl)hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably 0.03 to 0.15 mol, and most preferably 0.04 to 0.1 mol per L. As in the case of a color developing agent, a replenisher preferably contains a preservative at concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably 0.02 to 0.04 mol per L. Sulfite is preferably used at concentration 1.1 to 3 times the above concentration in a replenisher.

The pH of a color developer is preferably 9.8 to 11.0, and more preferably 10.0 to 10.5. In a replenisher, the pH is preferably set to be higher by 0.1 to 1.0 than these values. To stably maintain this pH, a know buffering agent such as carbonate, phosphate, sulfosalicylate, or borate is used.

The replenishment rate of a color developer is preferably 80 to 1,300 mL per $m^2$ of a sensitive material. However, the replenishment rate is preferably smaller in order to reduce environmental pollution. For example, the replenishment rate is preferably 80 to 600 mL, and more preferably 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: a bromide ion concentration (mol/L) in a color developer replenisher

A: a target bromide ion concentration (mol/L) in a color developer

W: an amount (mol) of bromide ions dissolving into a color developer from 1 $m^2$ of a sensitive material when the sensitive material is color-developed V: a replenishment rate (L) of a color developer replenisher for 1 $m^2$ of a sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention.

This bleaching agent preferably has an oxidation-reduction potential of 150 mV. Preferable practical examples of the bleaching agent are described in JP-A-5-72694 and JP-A-5-173312. In particular, 1,3-diaminopropane tetraacetic acid and compound ferric complex salt as practical example 1 in JP-A-5-173312, page 7 are preferable.

To improve the biodegradability of a bleaching agent, it is preferable to use compound ferric complex salts described in JP-A-4-251845, JP-A-4-268552, EP588,289, EP591,934, and JP-A-6-208213 as the bleaching agent. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably 0.3 to 0.8 mol of a bromide is added per L.

A replenisher of the solution having bleaching capacity basically contains components at concentrations calculated by the following equation. This makes it possible to maintain the concentrations in a mother solution constant.

$$C_R=C_T\times(V_1+V_2)/V_1+C_P$$

where $C_R$: concentrations of components in a replenisher $C_T$: concentrations of components in a mother solution (processing tank solution)

$C_P$: concentrations of components consumed during processing $V_1$: a replenishment rate (mL) of a replenisher having bleaching capacity per $m^2$ of a sensitive material $V_2$: an amount (mL) carried over from a pre-bath by $m^2$ of a sensitive material Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No. 17129, and U.S. Pat. No. 3,893,858 is preferable.

It is preferable to replenish 50 to 1,000 mL of a bleaching replenisher to a bleaching solution per $m^2$ of a sensitive material. The replenishment rate is more preferably 80 to 500 mL, and most preferably 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity.

To improve the fixing rate and preservability, compounds represented by formulas (I) and (II) described in JP-A-6-301169 are preferably added singly or together to a processing solution with fixing capacity. To improve the preservability, the use of sulfinic acid such as p-toluenesulfinate described in JP-A-1-224762 is also preferable.

To improve the desilvering characteristics, ammonium is preferably used as cation in a solution with bleaching capacity or a solution with fixing capacity. However, the amount of ammonium is preferably reduced or zero to reduce environmental pollution.

In the bleaching, bleach-fixing, and fixing steps, it is particularly preferable to perform jet stirring described in JP-A-1-309059.

The replenishment rate of a replenisher in the bleach-fixing or fixing step is preferably 100 to 1,000 mL, more preferably 150 to 700 mL, and more preferably 200 to 600 mL per $m^2$ of a sensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferable.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde.

To reduce adhesion of dust to a magnetic recording layer formed on a sensitive material, a stabilizer described in JP-A-6-289559 can be preferably used.

The replenishment rate of washing water and a stabilizer is preferably 80 to 1,000 mL, more preferably 100 to 500 mL, and most preferably 150 to 300 mL per $m^2$ of a sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030. A reverse permeable membrane used in this processing is preferably a low-pressure reverse permeable membrane.

In the processing of the present invention, it is particularly preferable to perform processing solution evaporation correction disclosed in JIII Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same JIII Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in PCT No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 $mL/m^2 \cdot 24$ hrs·atm or less.

Color reversal film processing solutions used in the present invention will be described below.

Processing for a color reversal film is described in detail in Aztech Ltd., Known Technology No. 6 (Apr. 1, 1991), page 1, line 5 to page 10, line 5 and page 15, line 8 to page 24, line 2, and any of the contents can be preferably applied.

In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

A magnetic recording layer preferably used in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma$ $Fe_2O_3$, Co-deposited $\gamma$ $Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma$ $Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$. The saturation magnetization ($\sigma s$) of the ferromagnetic substance is preferably $3.0\times10^4$ to $3.0\times10^5$ A/m, and most preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or JP-A-5-81652 can also be used.

As a binder used in the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 μm, preferably 0.2 to 5 μm, and more preferably 0.3 to 3 μm. The weight ratio of the magnetic grains to the binder is preferably 0.5:100 to 60:100, and more preferably 1:100 to 30:100. The coating amount of the magnetic grains is 0.005 to 3 g/m$^2$, preferably 0.01 to 2 g/m$^2$, and more preferably 0.02 to 0.5 g/m$^2$. The transmitting yellow density of the magnetic recording layer is preferably 0.01 to 0.50, more preferably 0.03 to 0.20, and most preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP466,130.

A polyester support used in the present invention will be described below. Details of the polyester support and sensitive materials, processing, cartridges, and examples (to be described later) are described in Journal of Technical Disclosure No. 94-6023 (JIII; Mar. 15, 1994). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is most preferable among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides. The content in a sensitive material is preferably 5 to 500 mg/$m^2$, and most preferably 10 to 350 mg/$m^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613. Photographic films used in the present invention can be so-called raw films before being developed or developed photographic films. Also, raw and developed photographic films can be accommodated in the same new cartridge or in different cartridges.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as Fuji Film EPION Series (e.g., EPION 300Z). A color photosensitive film of the present invention is also suited as a film with lens such as Fuji Film FUJICOLOR UTSURUNDESU SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, Fuji Film MINILABO CHAMPION SUPER FA-298, FA-278, FA-258, FA-238 and Fuji Film DIGITAL LABO SYSTEM FRONTIER are preferable. Examples of a processor for MINILABO CHAMPION are FP922AL, FP562B, FP562BAL, FP362B, and FP362BAL, and recommended processing chemicals are FUJICOLOR JUST-IT CN-16L AND CN-16Q. Examples of a printer processor are PP3008AR, PP3008A, PP1828AR, PP1828A, PP1258AR, PP1258A, PP728AR, and PP728A, and recommended processing chemicals are FUJICOLOR JUST-IT CP-47L and CP40FAII. In FRONTIER SYSTEM, Scanner & Image Processor SP-1000 and Laser Printer & Paper Processor LP-1000P or Laser Pinter LP-1000W are used. A detacher used in the detaching step and a reattacher used in the reattaching step are preferably Fuji Film DT200 or DT100 and AT200 or AT100, respectively.

The APS can also be enjoyed by PHOTO JOY SYSTEM whose main component is Fuji Film Digital Image Workstation Aladdin 1000. For example, a developed APS cartridge film is directly loaded into Aladdin 1000, or image information of a negative film, positive film, or print is input to Aladdin 1000 by using 35-mm Film Scanner FE-550 or Flat Head Scanner PE-550. Obtained digital image data can be easily processed and edited. This data can be printed out by Digital Color Printer NC-550AL using a photo-fixing heat-sensitive color printing system or PICTOROGRAPHY 3000 using a laser exposure thermal development transfer system, or by existing laboratory equipment through a film recorder. Aladdin 1000 can also output digital information directly to a floppy disk or Zip disk or to an CD-R via a CD writer.

In a home, a user can enjoy photographs on a TV set simply by loading a developed APS cartridge film into Fuji Film Photo Player AP-1. Image information can also be continuously input to a personal computer by loading a developed APS cartridge film into Fuji Film Photo Scanner AS-1. Fuji Film Photo Vision FV-10 or FV-5 can be used to input a film, print, or three-dimensional object. Furthermore, image information recorded in a floppy disk, Zip disk, CR-R, or hard disk can be variously processed on a computer by using Fuji Film Application Software Photo Factory. Fuji Film Digital Color Printer NC-2 or NC-2D using a photo-fixing heat-sensitive color printing system is suited to outputting high-quality prints from a personal computer.

To keep developed APS cartridge films, FUJICOLOR POCKET ALBUM AP-5 POP L, AP-1 POP L, AP-1 POP KG, or CARTRIDGE FILE 16 is preferable.

The present invention will be described by way of its examples, but the invention is not limited to these examples.

EXAMPLE 1

An undercoated cellulose triacetate film support was coated with a plurality of layers having the following compositions to form a sample 101 as a color sensitive material.

Compositions of Sensitive Layers

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener

ExS: Sensitizing dye

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

Sample 101

| | | |
|---|---|---|
| 1st layer (1st antihalation layer) | | |
| Black colloidal silver | silver | 0.10 |
| Silver iodobromide emulsion P | silver | 0.03 |
| Gelatin | | 0.44 |
| ExC-1 | | 0.004 |
| ExC-3 | | 0.006 |
| Cpd-2 | | 0.001 |
| HBS-1 | | 0.008 |
| HBS-2 | | 0.004 |
| 2nd layer (2nd antihalation layer) | | |
| Black colloidal silver | silver | 0.117 |
| Gelatin | | 0.691 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| ExC-2 | | 0.045 |
| Polyethylacrylate latex | | 0.20 |
| Gelatin | | 0.515 |
| 4th layer (Low-speed red-sensitive emulsion layer) | | |
| Silver iodobromide emulsion A | silver | 0.20 |
| Silver iodobromide emulsion B | silver | 0.40 |
| ExS-1 | | $2.7 \times 10^{-4}$ |
| ExS-2 | | $1.0 \times 10^{-5}$ |
| ExS-3 | | $2.8 \times 10^{-4}$ |
| ExS-4 | | $2.7 \times 10^{-4}$ |
| ExC-1 | | 0.18 |
| ExC-3 | | 0.036 |
| ExC-4 | | 0.12 |
| ExC-5 | | 0.018 |
| ExC-6 | | 0.003 |
| Cpd-2 | | 0.025 |
| HBS-1 | | 0.17 |
| Gelatin | | 1.26 |
| 5th layer (Medium-speed red-sensitive emulsion layer) | | |
| Silver iodobromide emulsion C | silver | 0.20 |
| Silver iodobromide emulsion D | silver | 0.60 |
| ExS-1 | | $2.2 \times 10^{-4}$ |
| ExS-2 | | $8 \times 10^{-5}$ |
| ExS-3 | | $2.3 \times 10^{-4}$ |
| ExS-4 | | $2.2 \times 10^{-4}$ |
| ExC-1 | | 0.18 |
| ExC-2 | | 0.040 |
| ExC-3 | | 0.042 |
| ExC-4 | | 0.12 |
| ExC-5 | | 0.015 |
| ExC-6 | | 0.010 |
| Cpd-2 | | 0.055 |
| Cpd-4 | | 0.030 |
| HBS-1 | | 0.15 |
| Gelatin | | 1.04 |
| 6th layer (High-speed red-sensitive emulsion layer) | | |
| Silver iodobromide emulsion E | silver | 1.17 |
| ExS-1 | | $4.0 \times 10^{-4}$ |
| ExS-2 | | $1 \times 10^{-5}$ |
| ExS-3 | | $2.1 \times 10^{-4}$ |
| ExC-1 | | 0.08 |
| ExC-3 | | 0.09 |
| ExC-6 | | 0.037 |
| ExC-7 | | 0.010 |
| Cpd-2 | | 0.046 |
| Cpd-4 | | 0.03 |
| HBS-1 | | 0.22 |
| HBS-2 | | 0.10 |
| Gelatin | | 1.14 |
| 7th layer (Interlayer) | | |
| Cpd-1 | | 0.094 |
| Solid disperse dye ExF-4 | | 0.030 |
| HBS-1 | | 0.050 |

-continued

| | | |
|---|---|---|
| Polyethylacrylate latex | | 0.15 |
| Gelatin | | 0.89 |
| 8th layer (layer for donating interlayer effect to red-sensitive layer) | | |
| Silver iodobromide emulsion F | silver | 0.40 |
| Silver iodobromide emulsion G | silver | 0.90 |
| ExS-4 | | $3.1 \times 10^{-5}$ |
| ExS-5 | | $2.0 \times 10^{-4}$ |
| ExS-6 | | $8.2 \times 10^{-4}$ |
| Cpd-4 | | 0.030 |
| ExM-2 | | 0.23 |
| ExM-3 | | 0.049 |
| ExY-1 | | 0.054 |
| HBS-1 | | 0.20 |
| HBS-3 | | 0.007 |
| Gelatin | | 1.29 |
| 9th layer (Low-speed green-sensitive emulsion layer) | | |
| Silver iodobromide emulsion H | silver | 0.16 |
| ExS-4 | | $2.4 \times 10^{-5}$ |
| ExS-5 | | $1.4 \times 10^{-4}$ |
| ExS-6 | | $6.5 \times 10^{-4}$ |
| ExM-2 | | 0.13 |
| ExM-3 | | 0.047 |
| HBS-1 | | 0.10 |
| HBS-3 | | 0.04 |
| Gelatin | | 0.38 |
| 10th layer (Medium-speed green-sensitive emulsion layer) | | |
| Silver iodobromide emulsion H | silver | 0.08 |
| Silver iodobromide emulsion I | silver | 0.21 |
| Silver iodobromide emulsion J | silver | 0.08 |
| ExS-4 | | $3.3 \times 10^{-5}$ |
| ExS-5 | | $3.0 \times 10^{-5}$ |
| ExS-6 | | $1.4 \times 10^{-4}$ |
| ExS-7 | | $7.2 \times 10^{-4}$ |
| ExS-8 | | $1.6 \times 10^{-4}$ |
| ExC-6 | | 0.015 |
| ExM-2 | | 0.093 |
| ExM-3 | | 0.037 |
| ExY-5 | | 0.004 |
| HBS-1 | | 0.08 |
| HBS-3 | | $4.0 \times 10^{-3}$ |
| Gelatin | | 0.41 |
| 11th layer (High-speed green-sensitive emulsion layer) | | |
| Silver iodobromide emulsion K | silver | 1.10 |
| ExS-4 | | $4.3 \times 10^{-5}$ |
| ExS-7 | | $1.0 \times 10^{-4}$ |
| ExS-8 | | $4.7 \times 10^{-4}$ |
| ExC-6 | | 0.005 |
| ExM-3 | | 0.070 |
| ExM-4 | | 0.028 |
| ExM-5 | | 0.026 |
| Cpd-3 | | 0.010 |
| Cpd-4 | | 0.050 |
| HBS-1 | | 0.23 |
| Polyethylacrylate latex | | 0.15 |
| Gelatin | | 1.18 |
| 12th layer (Yellow filter layer) | | |
| Yellow colloidal silver | silver | 0.047 |
| Cpd-1 | | 0.18 |
| Solid disperse dye ExF-5 | | 0.060 |
| Solid disperse dye ExF-6 | | 0.060 |
| Oil-soluble dye ExF-7 | | 0.010 |
| HBS-1 | | 0.094 |
| Gelatin | | 1.204 |
| 13th layer (Low-speed blue-sensitive emulsion layer) | | |
| Silver iodobromide emulsion L | silver | 0.15 |
| Silver iodobromide emulsion M | silver | 0.20 |
| Silver iodobromide emulsion N | silver | 0.15 |
| ExS-9 | | $8.0 \times 10^{-4}$ |
| ExC-1 | | 0.067 |

-continued

| | | |
|---|---|---|
| ExC-8 | | 0.013 |
| ExY-1 | | 0.047 |
| ExY-2 | | 0.50 |
| ExY-3 | | 0.20 |
| ExY-4 | | 0.010 |
| Cpd-2 | | 0.10 |
| Cpd-3 | | $4.0 \times 10^{-3}$ |
| HBS-1 | | 0.23 |
| Gelatin | | 1.45 |
| 14th layer (High-speed blue-sensitive emulsion layer) | | |
| Silver iodobromide emulsion O | silver | 0.96 |
| ExS-9 | | $3.6 \times 10^{-4}$ |
| ExC-1 | | 0.013 |
| ExY-2 | | 0.42 |
| ExY-3 | | 0.05 |
| ExY-6 | | 0.104 |
| Cpd-2 | | 0.07 |
| Cpd-3 | | $1.0 \times 10^{-3}$ |
| HBS-1 | | 0.14 |
| Gelatin | | 1.20 |
| 15th layer (1st protective layer) | | |
| Silver iodobromide emulsion Q | silver | 0.10 |
| UV-1 | | 0.12 |
| UV-2 | | 0.10 |
| UV-3 | | 0.16 |
| UV-4 | | 0.025 |
| HBS-1 | | 0.10 |
| HBS-4 | | $4.0 \times 10^{-2}$ |
| Gelatin | | 2.0 |
| 16th layer (2nd protective layer) | | |
| H-1 | | 0.40 |
| B-1 (diameter 1.7 $\mu$m) | | $5.0 \times 10^{-2}$ |
| B-2 (diameter 1.7 $\mu$m) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

Table 1 below shows the AgI contents, grain sizes, and the like of emulsions indicated by abbreviations in this example.

TABLE 1

| Emulsion | Average AgI content (%) | COV of inter-grain AgI content (%) | Average grain diameter (μm) (equivalent spherical diameter) | COV of grain diameter (%) | Equivalent circular diameter of projected area (μm) | Diameter/ thickness ratio |
|---|---|---|---|---|---|---|
| A | 5.0 | 18 | 0.54 | 19 | 0.81 | 5.1 |
| B | 3.7 | 16 | 0.43 | 19 | 0.58 | 3.2 |
| C | 5.4 | 15 | 0.51 | 19 | 1.1 | 7.0 |
| D | 4.7 | 16 | 0.66 | 22 | 1.36 | 5.5 |
| E | 4.0 | 15 | 1.00 | 20 | 1.58 | 6.0 |
| F | 6.3 | 18 | 0.60 | 19 | 0.82 | 5.5 |
| G | 7.5 | 22 | 0.85 | 24 | 1.30 | 5.0 |
| H | 3.7 | 16 | 0.43 | 19 | 0.58 | 3.2 |
| I | 5.4 | 15 | 0.55 | 20 | 0.86 | 6.2 |
| J | 5.4 | 15 | 0.66 | 23 | 1.10 | 7.0 |
| K | 8.8 | 18 | 0.84 | 26 | 1.03 | 3.7 |
| L | 1.7 | 10 | 0.46 | 15 | 0.5 | 4.2 |
| M | 8.8 | 24 | 0.64 | 23 | 0.85 | 5.2 |
| N | 7.2 | 20 | 0.50 | 16 | 0.80 | 4.7 |
| O | 6.3 | 18 | 1.05 | 20 | 1.46 | 3.7 |
| P | 0.9 | — | 0.07 | — | 0.07 | 1.0 |
| Q | 1.0 | — | 0.07 | — | 0.07 | 1.0 |

COV = coefficient of variation

In Table 1, (1) The emulsions L to O were subjected to reduction sensitization during grain preparation by using thiourea dioxide and thiosulfonic acid in accordance with examples in JP-A-2-191938.

(2) The emulsions A to O were subjected to gold sensitization, sulfur sensitization, and selenium sensitization in the presence of the spectral sensitizing dyes described in the individual sensitive layers and sodium thiocyanate in accordance with examples in JP-A-3-237450.

(3) The tabular grains were prepared by using low-molecular weight gelatin in accordance with examples in JP-A-1-158426.

(4) Dislocation lines as described in JP-A-3-237450 were observed in the tabular grains when a high-voltage electron microscope was used. Preparation of dispersions of organic solid disperse dyes.

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hrs. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP549,489A. The average grain size was found to be 0.06 μm.

Compounds used in the formation of the individual layers in this example were as follows.

ExC-1

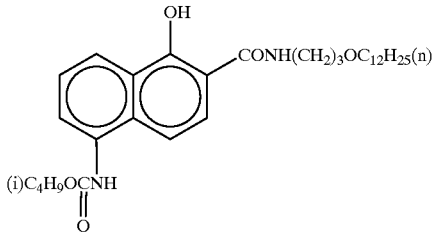

ExC-2

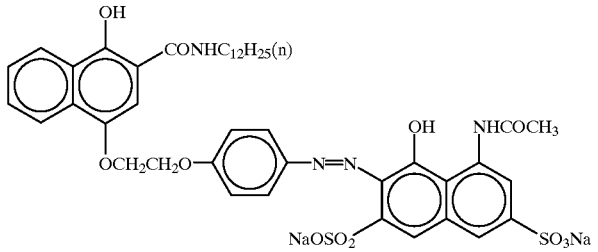

-continued
ExC-3
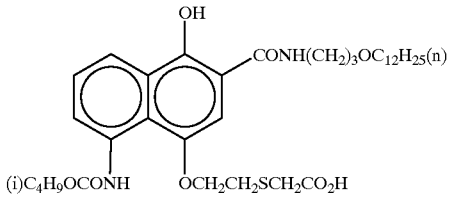
ExC-4
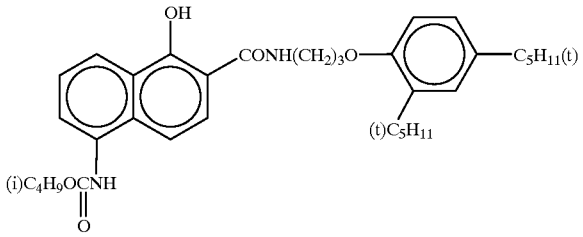
ExC-5
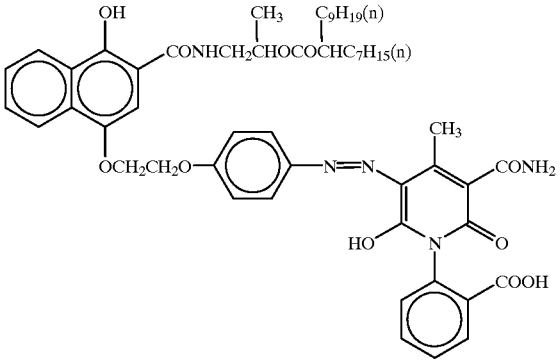
ExC-6
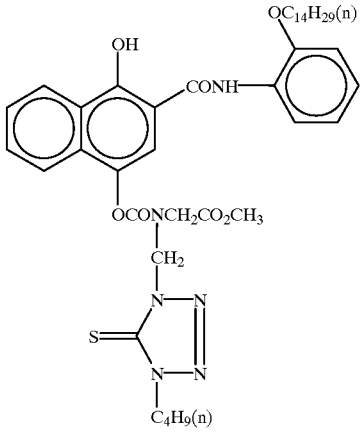
ExC-7
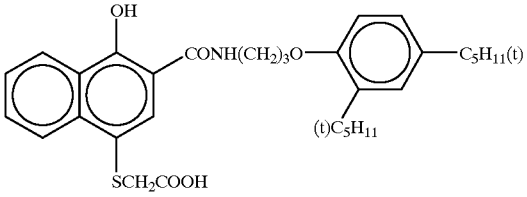
ExC-8
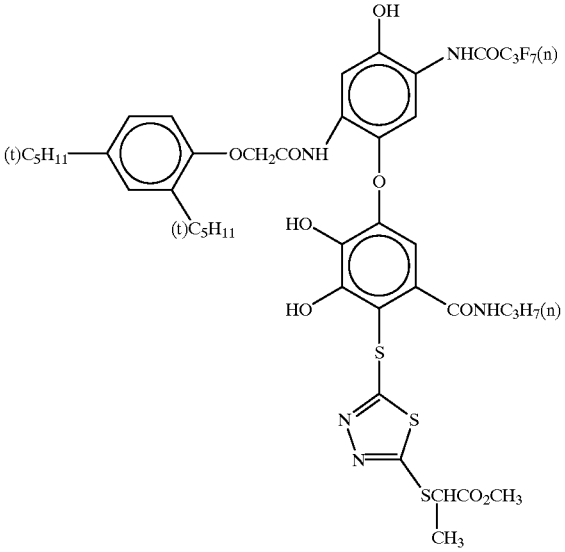

-continued
ExM-1
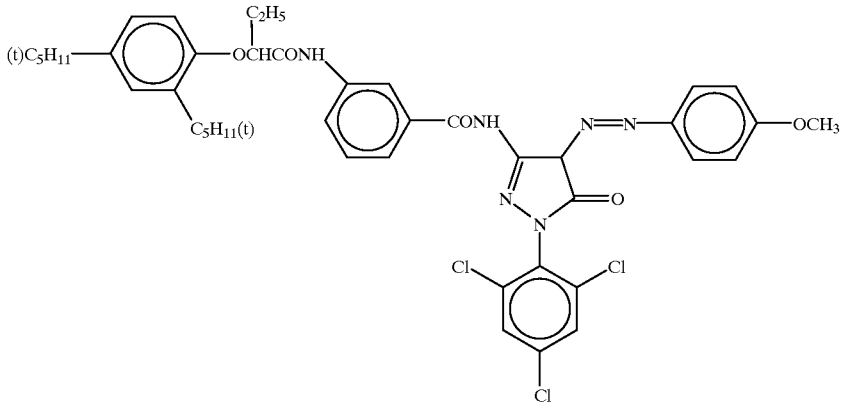
ExM-2
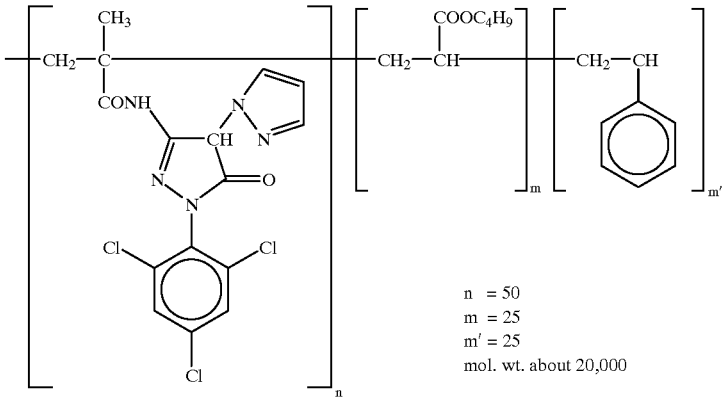
ExM-3
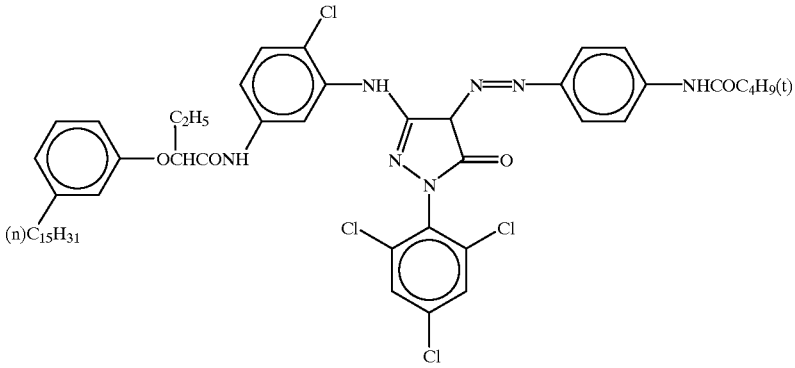
ExM-4
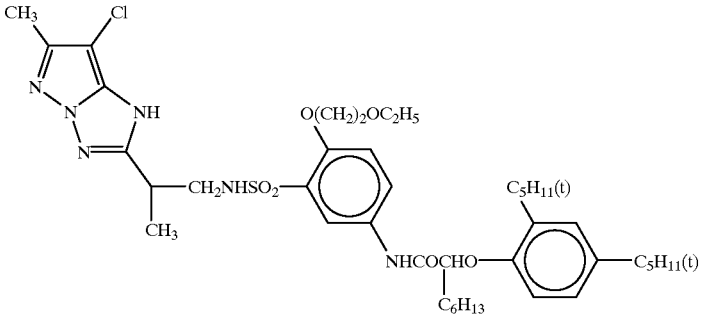

-continued
ExM-5
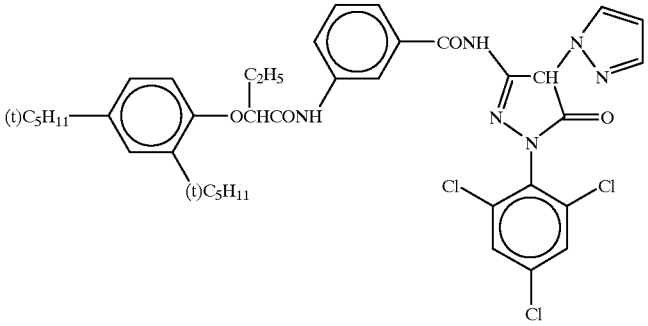
ExY-1
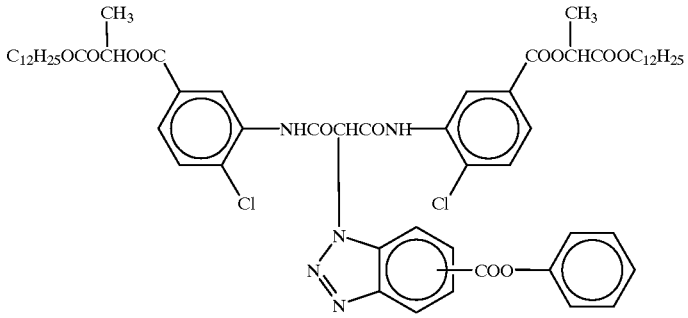
ExY-2
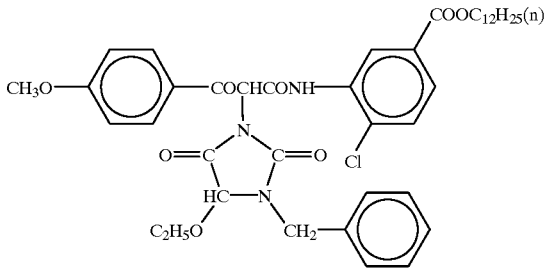
ExY-3
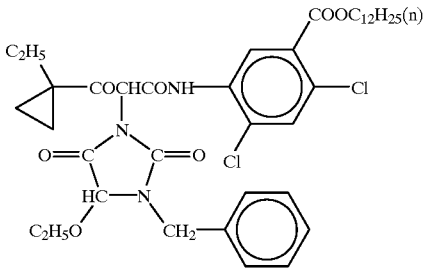
ExY-4
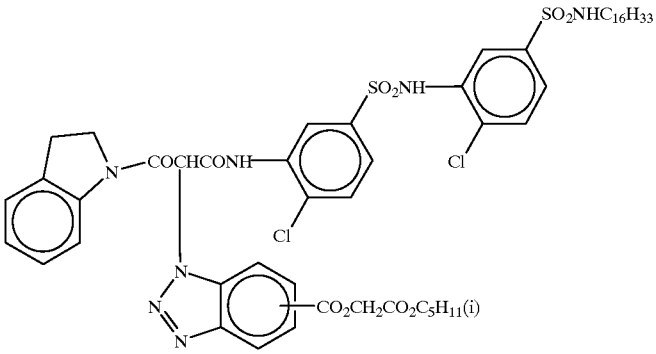

-continued
ExY-5
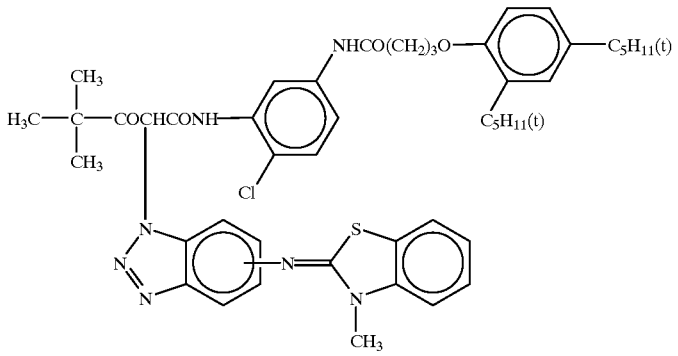
ExY-6
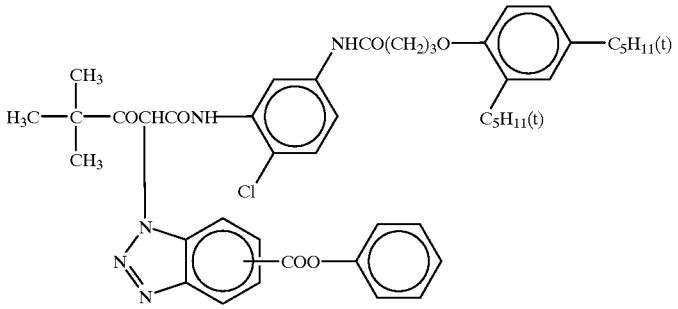
ExF-1
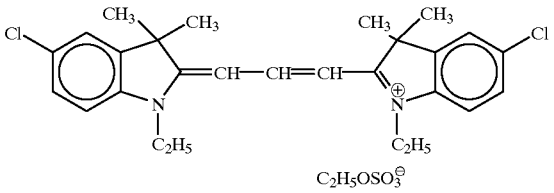
ExF-2
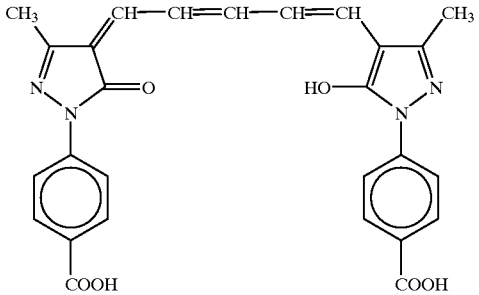
ExF-3
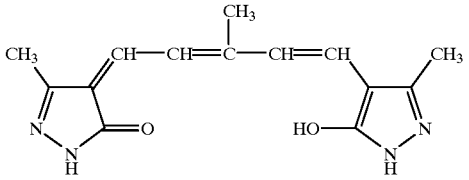
ExF-4
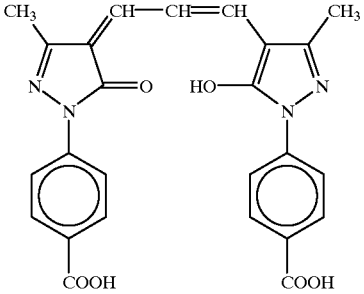
ExF-5
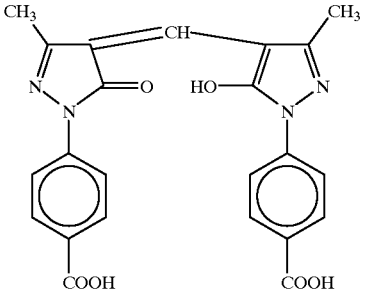
ExF-6
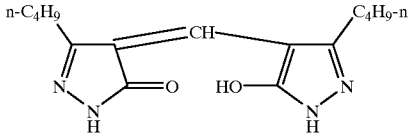

-continued
ExF-7
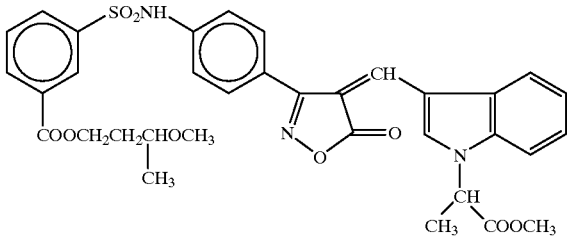
Cpd-1
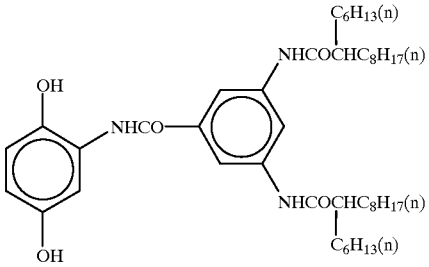
Cpd-2
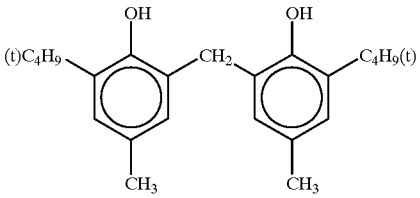
Cpd-3
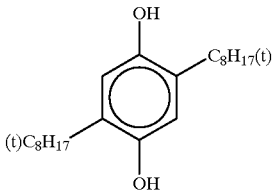
Cpd-4
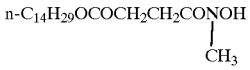
UV-1
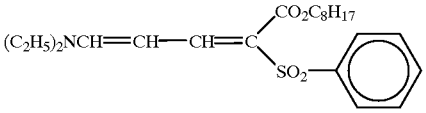
UV-2
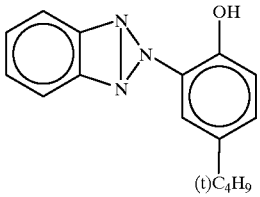
UV-3
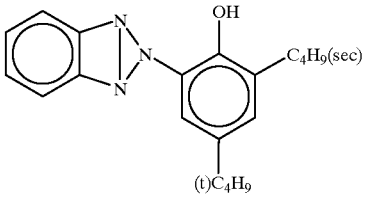
UV-4
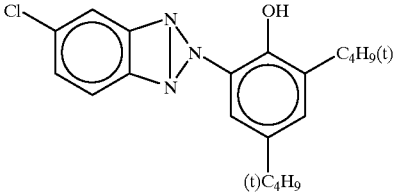
HBS-1
Tricresylphosphate
HBS-2
Di-n-butylphthalate
HBS-3
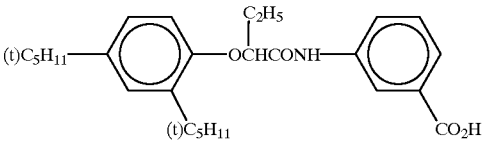
HBS-4
Tri (2-ethylhexyl) phosphate
ExS-1
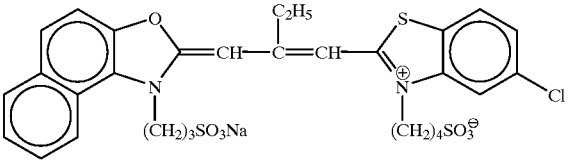

-continued
ExS-2
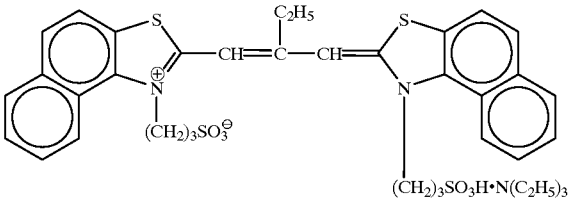
ExS-3
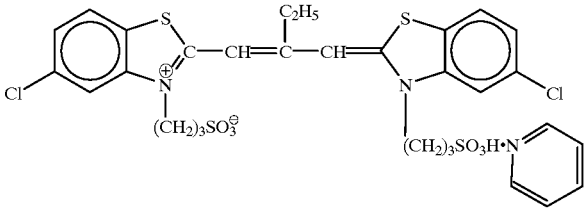
ExS-4
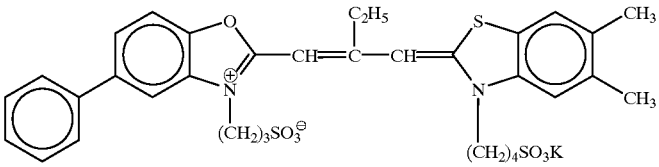
ExS-5
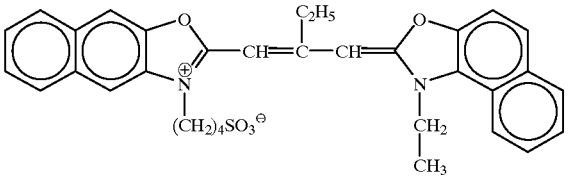
ExS-6
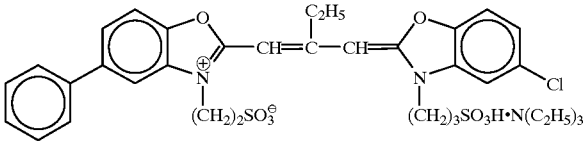
ExS-7
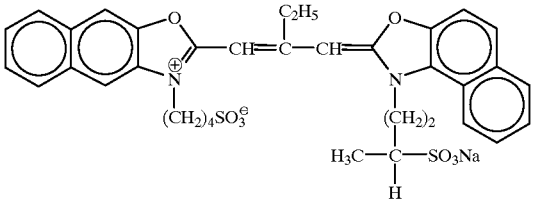
ExS-8
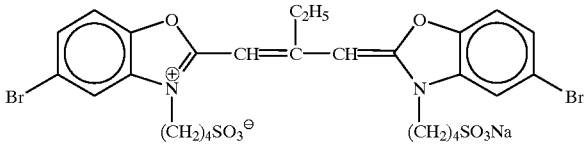
ExS-9
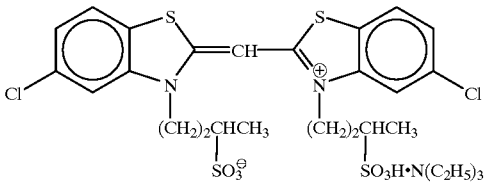
S-1
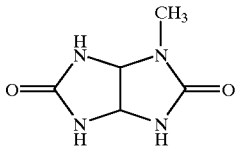
H-1
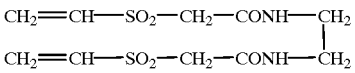
B-1
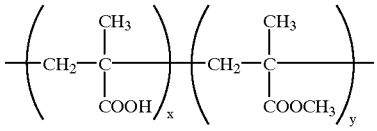
x/y = 10/90 (weight ratio)
Av. mol. wt. : about 35,000
B-2
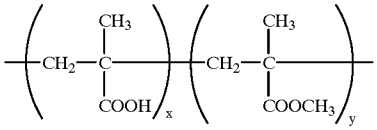
x/y = 40/60 (weight ratio)
Av. mol. wt. : about 20,000
B-3
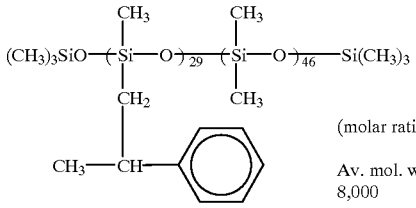
(molar ratio)
Av. mol. wt. : about 8,000
B-4
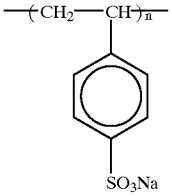
Av. mol. wt. : about 750,000
B-5
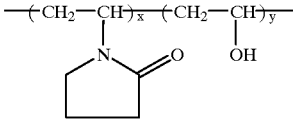
x/y = 70/30 (weight ratio)
Av. mol. wt. : about 17,000

-continued
B-6
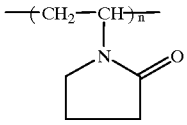
Av. mol. wt. : about 10,000
W-1
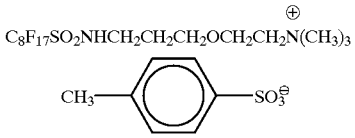
W-2
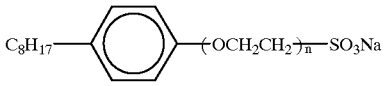
n = 2–4
W-3
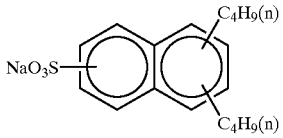
F-1
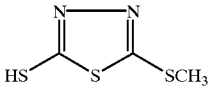
F-2
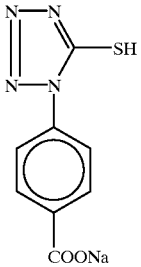
F-3
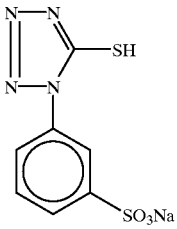
F-4
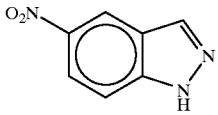
F-5
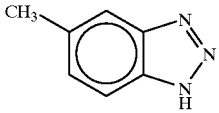
F-6
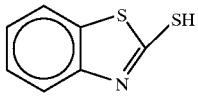
F-7
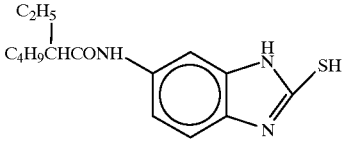
F-8
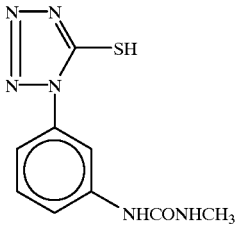
F-9
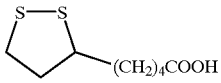
F-10
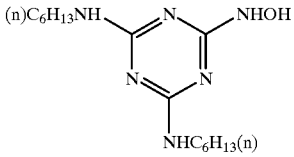

-continued

F-11

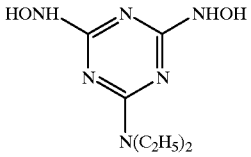

F-12

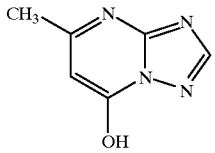

F-13

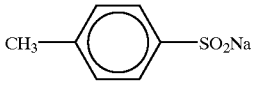

F-14

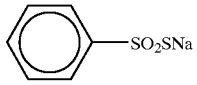

F-15

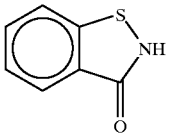

F-16

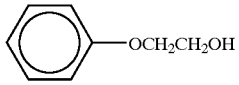

F-17

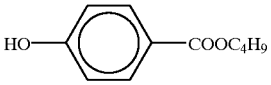

F-18

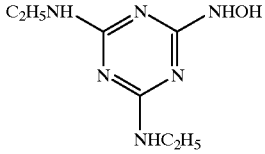

Comp-1

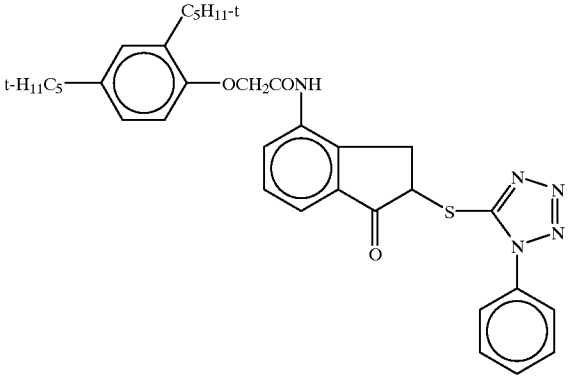

Comp-2

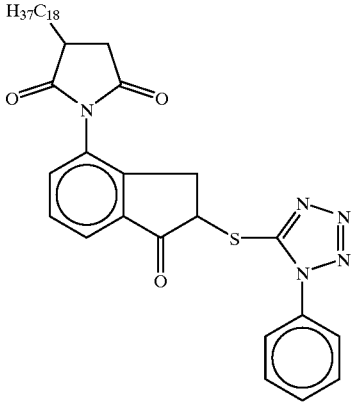

A method of developing each sample will be described below.

Processing Method

| Step | Time | Temperature |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The compositions of processing solutions were as follows.

| | (g) |
|---|---|
| (Color developer) | |
| Diethylenetriaminepentaacetic acid | 1.0 |
| 1-hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl) amino]-2-methylaniline sulfate | 4.5 |
| Water to make | 1.0L |
| pH (adjusted by potassium hydroxide and sulfuric acid) | 10.05 |
| (Bleach-fixing solution) | |
| Ferric sodium ethylenediamine tetraacetate trihydrate | 100.0 |
| Disodium ethylenediamine tetraacetate | 10.0 |
| 3-mercapto-1,2,4-triazole | 0.03 |
| Ammonium bromide | 140.0 |

-continued

| | (g) |
|---|---|
| Ammonium nitrate | 30.0 |
| Ammonia water (27%) | 6.5 mL |
| Water to make | 1.0L |
| pH (adjusted by ammonia water and nitric acid) | 6.0 |
| (Fixer) | |
| Disodium ethylenediaminetetraacetate | 0.5 |
| Ammonium sulfite | 20.0 |
| Aqueous ammonium thiosulfate solution (700 g/L) | 295.0 mL |
| Acetic acid (90%) | 3.3 |
| Water to make | 1.0L |
| pH (adjusted by ammonia water and acetic acid) | 6.7 |
| (Stabilizer) | |
| p-Nonylphenoxypolyglycidol (glycidol average polymerization degree 10) | 0.2 |
| Ethylenediaminetetraacetate | 0.05 |
| 1,2,4-triazole | 1.3 |
| 1,4-bis(1,2,4-triazole-1-ylmethyl) piperazine | 0.75 |
| Hydroxyacetic acid | 0.02 |
| Hydroxyethylcellulose (DAISERU KAGAKU HEC SP-2000) | 0.1 |
| 1,2-benzoisothiazoline-3-on | 0.05 |
| Water to make | 1.0L |
| pH | 8.5 |

Preparation of Samples 102–109

Samples 102 to 109 were prepared by replacing a part or the whole of ExC-6 in the 10th and 11th layers of the sample 101 with compounds shown in Table 2.

Preparation of Sample 110

A sample 110 was prepared by replacing ExM-3 in the 10th and 11th layers of the sample 101 with equal molar amounts of compounds shown in Table 2 and increasing the amounts of ExC-6 in these layers by 1.3 times.

Preparation of Samples 111 & 112

Samples 111 and 112 were prepared following the same procedures as for the sample 110 except that ExC-6 in one or both of the 10th and 11th layers was replaced with compounds shown in Table 2.

Preparation of Samples 113–116

Samples 113 to 116 were prepared following the same procedures as for the sample 101 except that a part or the whole of ExY-1 in the 13th layer was replaced as shown in Table 3.

Preparation of samples 117–120

Samples 117 to 120 were prepared following the same procedures as for the sample 101 except that a part or the whole of ExY-1 and ExM-3 in the eighth layer were replaced as shown in Table 3.

Preparation of Samples 121–125

Samples 121 to 125 were prepared following the same procedures as for the sample 101 except that a part or the whole of ExC-6 in one or both of the fifth and sixth layers was replaced as shown in Table 3.

Preparation of Samples 126 & 127

Samples 126 and 127 were prepared following the same procedures as for the sample 101 except that compounds represented by formula (I) of the present invention were added to the 12th layer as shown in Table 3.

Preparation of samples 128–130

Samples 128 to 130 were prepared following the same procedures as for the sample 101 except that compounds in a plurality of layers were replaced with equal molar amounts of compounds shown in Table 4.

TABLE 2

| Sample No. | Replacement of ExC-6 in 10th layer | Replacement of ExC-6 in 11th layer | Replacement of ExM-3 in 10th & 11th layers | Replacement of ExY-1 in 13th layer | $\frac{X}{X+Y}$ | Remarks |
|---|---|---|---|---|---|---|
| 101 | — | — | — | — | 0.00 | Comp. |
| 102 | ExY-1 | ExY-1 | — | — | 0.00 | Comp. |
| 103 | Comp1 | Comp1 | — | — | 0.14* | Comp. |
| 104 | Comp2 | Comp2 | — | — | 0.14* | Comp. |
| 105 | (3) × 0.2 + ExC-6 × 0.8 | (3) × 0.2 + ExC-6 × 0.8 | — | — | 0.03 | Comp. |
| 106 | (3) | (3) | — | — | 0.14 | Inv. |
| 107 | (44) × 0.5 + (30) × 0.5 | (44) | — | — | 0.14 | Inv. |
| 108 | (44) | (44) × 0.5 + (30) × 0.5 | — | — | 0.14 | Inv. |
| 109 | (3) × 0.5 + (44) × 0.5 | (3) × 0.5 + (44) × 0.5 | — | — | 0.14 | Inv. |
| 110 | ExC-6 × 1.3 | ExC-6 × 1.3 | ExM-4 | — | 0.00 | Comp. |
| 111 | (44) × 1.5 | — | ExM-4 | — | 0.24 | Comp. |
| 112 | ExC-6 × 0.5 | (30) × 2 | ExM-4 | — | 0.20 | Comp. |

Note

*Through the compounds of Comp1 and Comp2 are not within the scope of formula (I) of the invention, the usage ratio, X/(X + Y), is calculated by using the amounts thereof.

TABLE 3

| Sample NO. | Replacement of ExY-1 in 13th layer | Replacement of ExY-1 in 8th layer | Replacement of ExM-3 in 8th layer | Replacement of ExC-6 in 5th layer | Replacement of ExC-6 in 6th layer | Additive into 12th layer & amount thereof | $\frac{X}{X+Y}$ | Remarks |
|---|---|---|---|---|---|---|---|---|
| 113 | (44) × 0.2 + ExY − 1 × 0.8 | — | — | — | — | — | 0.05 | Comp. |
| 114 | (44) × 0.8 + ExY − 1 × 0.2 | — | — | — | — | — | 0.17 | Inv. |
| 115 | (44) | — | — | — | — | — | 0.22 | Inv. |
| 116 | (44) × 0.5 + (30) × 0.5 | — | — | — | — | — | 0.22 | Inv. |
| 117 | — | (3) × 0.5 + ExY − 1 × 0.5 | — | — | — | — | 0.24 | Inv. |
| 118 | — | (3) × 0.5 + (44) × 0.5 | — | — | — | — | 0.24 | Inv. |
| 119 | — | (3) × 0.5 + ExY − 1 × 0.5 | ExM-4 | — | — | — | 0.50 | Inv. |
| 120 | — | (44) | ExM-4 | — | — | — | 1.00 | Inv. |
| 121 | — | — | — | (3) × 0.1 + ExC − 6 × 0.9 | (44) × 0.1 + ExC − 6 × 0.9 | — | 0.05 | Comp. |
| 122 | — | — | — | (3) × 0.5 + ExC − 6 × 0.5 | (44) × 0.5 + ExC − 6 × 0.5 | — | 0.25 | Inv. |
| 123 | — | — | — | — | (3) | — | 0.45 | Inv. |
| 124 | — | — | — | (44) | (44) | — | 0.50 | Inv. |
| 125 | — | — | — | — | (3) × 0.5 + (44) × 0.5 | — | 0.45 | Inv. |
| 126 | — | — | — | — | — | (44) 0.010 | 1.00 | Inv. |
| 127 | — | — | — | — | — | (3) 0.005 + (44) 0.005 | 1.00 | Inv. |

TABLE 4

| Sample No. | Replacement of ExC-6 in 10th layer | Replacement of ExC-6 in 11th layer | Replacement of ExY-1 in 13th layer | Replacement of ExY-1 in 8th layer | Replacement of ExM-3 in 8th layer | $\frac{X}{X+Y}$ | | Remarks |
|---|---|---|---|---|---|---|---|---|
| 128 | — | — | (44) | (44) | ExM-4 | Blue sensitive layer: 0.22 | Donor layer: 1.00 | Inv. |
| 129 | (44) | (44) | — | (44) | ExM-4 | Green sensitive layer: 0.14 | Donor layer: 1.00 | Inv. |
| 130 | (44) | (44) | (44) | — | — | Green sensitive layer: 0.14 | Blue sensitive layer: 0.22 | Inv. |

The samples 101 to 128 were wedge-exposed by a standard white light source having an energy distribution of blackbody radiation of 4,800° K. and developed.

The cyan, magenta, and yellow absorption densities of each processed sample were measured to obtain characteristic curves. From these obtained characteristic curves, cyan, magenta, and yellow gradation levels $\gamma_C$, $\gamma_M$, and $\gamma_Y$ and minimum color generation density $D_{min}(Y)$ of yellow were obtained.

The image stability was evaluated by discoloration ΔY of a maximum color generation density portion of yellow obtained when each processed sample subjected to the density measurements was aged under 60° C., 70% light-shielding conditions for 14 days and again subjected to density measurements.

TABLE 5

| Sample No. | γ C | γ M | γ Y | $D_{min}(Y)$ | ΔY | Remarks |
|---|---|---|---|---|---|---|
| 101 | 0.80 | 0.78 | 0.81 | 0.80 | −0.11 | Comp. |
| 102 | 0.75 | 0.79 | 0.84 | 0.80 | −0.17 | Comp. |
| 103 | 0.83 | 0.95 | 0.91 | 0.80 | −0.11 | Comp. |
| 104 | 0.84 | 0.94 | 0.91 | 0.80 | −0.12 | Comp. |
| 105 | 0.79 | 0.79 | 0.81 | 0.80 | −0.12 | Comp. |
| 106 | 0.73 | 0.79 | 0.80 | 0.80 | −0.11 | Inv. |
| 107 | 0.73 | 0.78 | 0.80 | 0.80 | −0.11 | Inv. |
| 108 | 0.74 | 0.80 | 0.81 | 0.80 | −0.12 | Inv. |
| 109 | 0.73 | 0.77 | 0.79 | 0.80 | −0.11 | Inv. |
| 110 | 0.81 | 0.77 | 0.82 | 0.56 | −0.12 | Comp. |
| 111 | 0.71 | 0.77 | 0.80 | 0.56 | −0.11 | Inv. |
| 112 | 0.69 | 0.75 | 0.79 | 0.55 | −0.12 | Inv. |
| 113 | 0.80 | 0.79 | 0.80 | 0.80 | −0.09 | Comp. |
| 114 | 0.79 | 0.80 | 0.81 | 0.80 | −0.04 | Inv. |
| 115 | 0.78 | 0.80 | 0.77 | 0.80 | −0.03 | Inv. |
| 116 | 0.79 | 0.77 | 0.76 | 0.80 | −0.03 | Inv. |

TABLE 5-continued

| Sample No. | γ C | γ M | γ Y | $D_{min}$(Y) | ΔY | Remarks |
|---|---|---|---|---|---|---|
| 117 | 0.79 | 0.78 | 0.81 | 0.80 | −0.08 | Inv. |
| 118 | 0.78 | 0.77 | 0.80 | 0.80 | −0.07 | Inv. |
| 119 | 0.78 | 0.78 | 0.80 | 0.67 | −0.08 | Inv. |
| 120 | 0.79 | 0.78 | 0.80 | 0.67 | −0.07 | Inv. |
| 121 | 0.80 | 0.79 | 0.81 | 0.80 | −0.12 | Comp. |
| 122 | 0.75 | 0.79 | 0.81 | 0.80 | −0.11 | Inv. |
| 123 | 0.76 | 0.79 | 0.80 | 0.80 | −0.11 | Inv. |
| 124 | 0.73 | 0.79 | 0.79 | 0.80 | −0.11 | Inv. |
| 125 | 0.72 | 0.79 | 0.80 | 0.81 | −0.10 | Inv. |
| 126 | 0.77 | 0.75 | 0.75 | 0.80 | −0.11 | Inv. |
| 127 | 0.76 | 0.74 | 0.74 | 0.81 | −0.10 | Inv. |
| 128 | 0.71 | 0.78 | 0.75 | 0.55 | −0.01 | Inv. |
| 129 | 0.69 | 0.76 | 0.77 | 0.55 | −0.07 | Inv. |
| 130 | 0.72 | 0.78 | 0.77 | 0.80 | −0.08 | Inv. |

Table 5 shows that compounds represented by formula (I) of the present invention achieve the following effects: (i) a large interlayer effect can be obtained from green-sensitivity layers to both blue- and red-sensitive layers, (ii) the use amount of colored couplers can be reduced without decreasing the interlayer effect to red-sensitive layers, (iii) a sensitive material having high image stability can be obtained without decreasing the interlayer effect, (iv) correction of the hue of unpreferable DIR couplers is unnecessary, (v) a development inhibiting effect can be given from red-sensitivity layers to layers containing compounds represented by formula (I) of the present invention and green-sensitive layers at the same time, and (vi) this development inhibiting effect and a color amalgamation preventing effect can be achieved even when compounds represented by formula (I) of the present invention are added to interlayers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A silver halide color photosensitive material comprising a blue-sensitive silver halide emulsion layer, a green-sensitive silver halide emulsion layer, and a red-sensitive silver halide emulsion layer on a support, wherein at least one layer of the material contains a compound represented by formula (I) below in an amount that satisfies a relation:

$$X/(X+Y) \geqq 0.14$$

wherein X is the molar amount of the compound represented by formula (I); and Y is the molar amount of a functional coupler other than the compound represented by formula (I) in the same color-sensitive layer or the color-sensitive layers having the same color sensitivity as the color-sensitive layer to which the compound is added, or in the same non-sensitive layer to which the compound is added;

COUP—A—E—B Formula (I)

wherein COUP represents a coupler moiety capable of coupling with an oxidized form of an aromatic amine-based developing agent; E represents an electrophilic portion; A represents a coupling group capable of releasing B, along with ring formation, by intramolecular nucleophilic substitution between a nitrogen atom, which originates from the aromatic amine-based developing agent and directly bonds to the coupling position in the coupling product of COUP and the oxidized form of the developing agent, and the electrophilic portion E; and B represents a development inhibitor or its precursor.

2. The material according to claim 1, wherein the compound represented by formula (I) is contained in the green-sensitive layer.

3. The material according to claim 1, wherein the compound represented by formula (I) is contained in the blue-sensitive layer.

4. The material according to claim 1, wherein the compound represented by formula (I) is contained in an interlayer effect donor layer by which a barycentric wavelength, $\gamma_{-R}$, of a magnitude distribution of an interlayer effect given to at least one red-sensitive layer at a wavelength of 500 to 600 nm satisfies a relation:

$$500\ \text{nm} \leqq \gamma_{-R} \leqq 600\ \text{nm}$$

and a relation:

$$\gamma_G - \gamma_{-R} \geqq 5\ \text{nm}$$

wherein $\gamma_G$ is a barycentric wavelength of the green-sensitive layer.

5. The material according to claim 1, wherein the compound represented by formula (I) is contained in the red-sensitive layer.

6. The material according to claim 1, wherein the compound represented by formula (I) is contained in a non light-sensitive layer.

7. The material according to claim 1, wherein the molar ratio, X/(X+Y), is 0.30 or more.

8. The material according to claim 7, wherein the compound represented by formula (I) is contained in the green sensitive layer.

9. The material according to claim 7, wherein the compound represented by formula (I) is contained in the blue sensitive layer.

10. The material according to claim 7, wherein the compound represented by formula (I) is contained in the interlayer effect donor layer by which a barycentric wavelength, $\lambda_{-R}$, of a magnitude distribution of an interlayer effect given to at least one red-sensitive layer at a wavelength of 500 to 600 nm satisfies the relation:

$$500\ \text{nm} \leqq \lambda_{-R} \leqq 600\ \text{nm}$$

and the relation:

$$\lambda_G - \lambda_{-R} \geqq 5\ \text{nm}$$

wherein $\lambda_G$ is a barycentric wavelength of the green-sensitive layer.

11. The material according to claim 7, wherein the compound represented by formula (I) is contained in the red sensitive layer.

12. The material according to claim 7, wherein the compound represented by formula (I) is contained in a non light-sensitive layer.

13. The material according to claim 1, wherein the molar ratio, X/(X+Y), is 0.50 or more.

14. The material according to claim 13, wherein the compound represented by formula (I) is contained in the green sensitive layer.

15. The material according to claim 13, wherein the compound represented by formula (I) is contained in the blue sensitive layer.

16. The material according to claim 13, wherein the compound represented by formula (I) is contained in the interlayer effect donor layer by which a barycentric wavelength, $\lambda_{-R}$, of a magnitude distribution of an interlayer effect given to at least one red-sensitive layer at a wavelength of 500 to 600 nm satisfies the relation:

$$500\ \text{nm} \leqq \lambda_{-R} \leqq 600\ \text{nm}$$

and the relation:

$$\lambda_G - \lambda_{-R} \geqq 5\ \text{nm}$$

wherein $\lambda_G$ is a barycentric wavelength of the green-sensitive layer.

17. The material according to claim 13, wherein the compound represented by formula (I) is contained in the red sensitive layer.

18. The material according to claim 13, wherein the compound represented by formula (I) is contained in a non light-sensitive layer.

* * * * *